US007633004B2

(12) United States Patent
Isozaki et al.

(10) Patent No.: US 7,633,004 B2
(45) Date of Patent: Dec. 15, 2009

(54) ONBOARD MUSIC REPRODUCTION APPARATUS AND MUSIC INFORMATION DISTRIBUTION SYSTEM

(75) Inventors: Yoshimasa Isozaki, Hamamatsu (JP); Kiyoshi Yamaki, Iwata (JP); Daisuke Morishita, Hamamatsu (JP)

(73) Assignee: Yamaha Corporation (JP)

( * ) Notice: Subject to any disclaimer, the term of this patent is extended or adjusted under 35 U.S.C. 154(b) by 8 days.

(21) Appl. No.: 11/950,059

(22) Filed: Dec. 4, 2007

(65) Prior Publication Data

US 2008/0202323 A1 Aug. 28, 2008

(30) Foreign Application Priority Data

| | | |
|---|---|---|
| Dec. 6, 2006 | (JP) | 2006-329489 |
| Dec. 11, 2006 | (JP) | 2006-333417 |
| Dec. 11, 2006 | (JP) | 2006-333853 |
| Dec. 11, 2006 | (JP) | 2006-333856 |
| Feb. 16, 2007 | (JP) | 2007-036672 |

(51) Int. Cl.
*G10H 7/00* (2006.01)

(52) U.S. Cl. ..... 84/612

(58) Field of Classification Search ..... 84/602, 84/612

See application file for complete search history.

(56) References Cited

U.S. PATENT DOCUMENTS

| | | | | |
|---|---|---|---|---|
| 4,995,294 A | * | 2/1991 | Kashio et al. | 84/738 |
| 5,062,341 A | * | 11/1991 | Reiling et al. | 84/702 |
| 5,157,614 A | | 10/1992 | Kashiwazaki et al. | |
| 5,192,823 A | * | 3/1993 | Suzuki et al. | 84/600 |
| 5,557,683 A | * | 9/1996 | Eubanks | 381/86 |
| 5,633,985 A | | 5/1997 | Severson et al. | |
| 5,885,085 A | * | 3/1999 | Fujita | 434/307 A |

(Continued)

FOREIGN PATENT DOCUMENTS

EP 1562176 A1 8/2005

(Continued)

OTHER PUBLICATIONS

Extended search report, dated Jun. 4, 2008, issued in European application No. 07023346.5-2225, which corresponds to related co-pending U.S. Appl. No. 11/950,033.

(Continued)

*Primary Examiner*—Jeffrey Donels
(74) *Attorney, Agent, or Firm*—Rossi, Kimms & McDowell LLP

(57) ABSTRACT

In a music reproduction apparatus designed for a listener to enjoy music while experiencing variations in vehicle status, plural types of phrases, which differ from each other, are assigned to plural tracks and are reproduced in accordance with reproduction parameters, which are controlled in response to vehicle status information. It is possible to control the setup values of reproduction parameters suiting vehicle statuses in response to travel environments. In addition, it is possible to synchronize the reproduction start timing of a music reproduction unit corresponding to one measure being reproduced by a first track with the reproduction start timing of a music reproduction unit corresponding to plural measures being reproduced by a second track. In a music information distribution system, a server stores music files including reproduction parameters suiting vehicle statuses and travel environments, so that the music reproduction apparatus reads them so as to reproduce corresponding musical tunes.

10 Claims, 22 Drawing Sheets

U.S. PATENT DOCUMENTS

| | | | | |
|---|---|---|---|---|
| RE36,387 | E * | 11/1999 | Rosenberg et al. | 702/139 |
| 6,230,140 | B1 | 5/2001 | Severson et al. | |
| 6,838,610 | B2 * | 1/2005 | de Moraes | 84/730 |
| 7,053,288 | B2 * | 5/2006 | Iwai et al. | 84/600 |
| 7,053,289 | B2 * | 5/2006 | Iwai et al. | 84/600 |
| 7,317,158 | B2 * | 1/2008 | Yamamoto | 84/612 |
| 2003/0079600 | A1 * | 5/2003 | de Moraes | 84/735 |
| 2004/0244568 | A1 * | 12/2004 | Nakabo et al. | 84/615 |
| 2005/0172788 | A1 * | 8/2005 | Yamamoto | 84/611 |
| 2005/0188821 | A1 * | 9/2005 | Yamashita et al. | 84/611 |
| 2006/0052167 | A1 * | 3/2006 | Boddicker et al. | 463/37 |
| 2007/0234888 | A1 * | 10/2007 | Rotolo de Moraes | 84/730 |

FOREIGN PATENT DOCUMENTS

| | | | |
|---|---|---|---|
| JP | 8248953 | A | 9/1996 |
| JP | 9292247 | A | 11/1997 |
| JP | 2001-189969 | A | 7/2001 |
| JP | 2002-114107 | A | 4/2002 |
| JP | 2003-150176 | A | 5/2003 |
| JP | 2003-309891 | A | 10/2003 |
| JP | 2004-051081 | A | 2/2004 |

OTHER PUBLICATIONS

Partial European Search Report of Corresponding application No. 07023425.7-2225, dated Mar. 25, 2008.

Partial European search report, mailed Apr. 14, 2008, issued in EP patent application No. 07023346.5-2225, which corresponds to related co-pending U.S. Appl. No. 11/950,033.

Specification and drawings of un-published related co-pending U.S. Appl. No. 11/950,033, filed Dec. 4, 2007. "Musical sound generating vehicular apparatus, musical sound generating method and program"; Yoshimasa Isozaki; 45 pages.

* cited by examiner

ONBOARD MUSIC REPRODUCTION APPARATUS AND MUSIC INFORMATION DISTRIBUTION SYSTEM

BACKGROUND OF THE INVENTION

1. Field of the Invention

The present invention relates to onboard music reproduction apparatuses that reproduce music based on music reproduction methods in response to travel conditions and operating conditions of vehicles. The present invention also relates to music information distribution systems that provide music information to onboard music reproduction apparatuses via servers and networks.

The present application claims priorities on five Japanese patent applications, i.e., Japanese Patent Application No. 2006-329489 (filing date: Dec. 6, 2006), Japanese Patent Application No. 2006-333856 (filing date: Dec. 11, 2006), Japanese Patent Application No. 2006-333853 (filing date: Dec. 11, 2006), Japanese Patent Application No. 2006-333417 (filing date: Dec. 11, 2006), and Japanese Patent Application No. 2007-36672 (filing date: Feb. 16, 2007), the contents of which are incorporated herein by reference.

2. Description of the Related Art

Conventionally, technologies for reproducing effect sounds and musical tones with volumes, pitches, and tempos (hereinafter, referred to as reproduction parameters) in response to travel conditions and operating conditions of vehicles (hereinafter, referred to as vehicle statuses), have been developed. Onboard audio apparatuses have been disclosed in Japanese Unexamined Patent Application Publication No. 2004-51081, Japanese Unexamined Patent Application Publication No. 2003-309891, and Japanese Unexamined Patent Application Publication No. 2002-114107, for example. Japanese Unexamined Patent Application Publication No. 2003-309891 discloses the technology for changing reproduction parameters (e.g., volumes, pitches, and tempos) of reproduced sounds in response to engine speeds.

Although the aforementioned technologies allow drivers of vehicles (or companions sharing the same vehicles; hereinafter, referred to as listeners) to experience variations in the vehicle statuses by way of variations of reproduction parameters, they are each designed to simply reproduce the music while varying a single reproduction parameter, so that the reproduced music will become monotonous. For this reason, there is a demand to develop technologies that allow listeners to enjoy music while experiencing variations of vehicle statuses.

Japanese Unexamined Patent Application Publication No. 2004-51081 discloses an onboard music reproduction apparatus that changes volumes, pitches, tone colors, and effects in response to operations of a steering wheel and an acceleration pedal of a vehicle.

Japanese Unexamined Patent Application Publication No. 2003-150176 discloses an onboard music reproduction apparatus that reproduces music in response to travel environments (i.e., congested roads, speedways, specific positions and areas, weathers, etc.) during the traveling of a vehicle.

Although the aforementioned technologies are capable of changing reproduction parameters in response to vehicle statuses, the reproduced music will become unnatural to hear. Concrete examples will be described below.

The technology for changing reproduction parameters between high-speed travel and low-speed travel will now be explained. In the conventionally-known technologies, onboard music reproduction apparatuses are each designed to change reproduction parameters in response to the speed of a vehicle. Specifically, preset values of reproduction parameters are determined in response to the speed in advance, so that the onboard music reproduction apparatus controls reproduction parameters to match preset values suiting the present speed of a vehicle.

However, the high-speed travel and low-speed travel depend upon drivers' subjective views; hence, travel environments may greatly affect the criterion for judgments with regard to a distinction therebetween. For example, a driver may experience high-speed travel with the speed of 40 km/h or more while running an urban road of the speed limit of 50 km/h, whereas the driver may experience low-speed travel with the speed of 80 km/h while running a speedway of the speed limit of 100 km/h. In the conventionally-known technologies in which reproduction parameters are determined in advance in correspondence with the speed of a vehicle, it is necessary to determine reproduction parameters in correspondence with the speed of the vehicle after it is recognized whether the speed of the vehicle is regarded as low speed or high speed. That is, it is necessary to make a distinction regarding the criterion for judgments between the high-speed travel and the low-speed travel in response to travel environments; however, the conventionally-known technologies are not designed in such a manner, so that the reproduced music must become unnatural to hear due to travel environments.

In addition, music reproduction apparatuses, which are capable of repeatedly reproducing one or plural music reproduction units, have been known. As music reproduction units, it is possible to list rhythm patterns of prescribed time lengths, which are reproduced by way of rhythm boxes, for example.

When the aforementioned music reproduction apparatus repeats music reproduction units so as to produce sound via a speaker, the reproduced music will become monotonous. For this reason, there is a demand to realize music reproduction of rich variations in response to external environments such as vehicle statuses.

The conventionally-known technology disclosed in Japanese Unexamined Patent Application Publication No. 2003-309891 is capable of applying variations of the volume, pitch, and tempo to reproduced musical tone signals in response to vehicle statuses; hence, it is possible to apply desired variations to the reproduced music in response to vehicle statuses.

However, the aforementioned technology is designed to simply apply variations to reproduced musical tone signals, which are not changed at all; hence, there is a limit in realization of music reproduction of rich variations.

Japanese Unexamined Patent Application Publication No. 2001-189969 discloses an example of a music distribution system, in which, when an onboard information communication terminal requests an information center to download music information thereto, for example, it transmits vehicle status information representing the travel position and travel speed of a vehicle and user setup information representing sensations of a driver and a companion sharing the same vehicle, so that it receives music information suiting the vehicle status information and the user setup information so as to perform music reproduction in the vehicle.

The aforementioned music distribution system is designed to simply select music information, which is recommended in response to the vehicle status information and the user setup information, so as to download it to the onboard information communication terminal, whereas it is difficult to control a musical tune suiting the vehicle status information in response to the travel environments of a vehicle so as to autonomously reproduce a musical tune in response to the vehicle status information. In addition, it is very difficult to provide a musical tune, which the user can enjoy in response to the vehicle status and travel environments.

SUMMARY OF THE INVENTION

It is an object of the present invention to provide an onboard music reproduction apparatus, which allows a listener such as a driver of a vehicle to experience variations of vehicle statuses and to enjoy the reproduced music.

It is another object of the present invention to provide an onboard music reproduction apparatus, which varies the reproduction parameter of music in response to a vehicle status in such a way that the reproduced music does not become unnatural to hear due to differences of travel environments.

It is a further object of the present invention to provide a music reproduction apparatus, which realizes music reproduction of rich variations in response to external environments even when one or plural music reproduction units are repeatedly reproduced.

It is a further object of the present invention to provide a music information distribution system, which is capable of selecting optimum musical tune data in response to the position and the moving condition of a mobile unit such as a vehicle and a portable terminal, and which is linked to a music reproduction apparatus capable of varying a musical tune in accordance with a reproduction method suiting music reproduction environments.

In a first aspect of the present invention, a music reproduction apparatus includes a vehicle status information input section for inputting vehicle status information representing a vehicle status, a reproduction section for assigning a plurality of phrases whose types differ from each other to a plurality of tracks, thus reproducing the phrases in terms of at least one reproduction parameter being controlled with respect to each of the tracks, and a control section (corresponding to a reproduction parameter control section shown in FIG. 1A) for controlling the reproduction parameter in response to the vehicle status information with respect to each of the tracks. Herein, the reproduction section and the control section are included in the tone generation control section shown in FIG. 1A.

In the above, it is possible to independently control reproduction parameters in response to the vehicle status with respect to types of phrases. Thus, it is possible to vary plural reproduction patterns of musical tones being simultaneously generated in various manners, thus allowing a listener to enjoy music while experiencing variations of vehicle status.

The aforementioned music reproduction apparatus further includes a setup value storage for storing the setup values of reproduction parameters in advance in correspondence with the vehicle status information, wherein the control section reads the setup values from the setup value storage in response to the vehicle status information, thus controlling reproduction parameters based on the read setup values with respect to the tracks. Herein, it is possible to store a control method for reproduction parameters as setup values with respect to the types of phrases. The aforementioned setup values can be determined directly with respect to the vehicle status information.

The reproduction parameter corresponds to at least one of the volume, pitch, tempo, tone color, and tone-generation timing. That is, when the tracks reproduce phrases, the control section controls at least one of the volume, pitch, tempo, tone color, and tone-generation timing.

The aforementioned music reproduction apparatus further includes a travel environment information input section for inputting travel environment information representing a travel environment of a vehicle, a phrase storage (corresponding to a sound database shown in FIG. 1A) for storing the phrases in advance in correspondence with the travel environment information, and an assignment section (corresponding to a sound selection control section shown in FIG. 1A) for selectively assigning the phrases, which are stored in the phrase storage in correspondence with the travel environment information, to the tracks, thus reproducing the phrases assigned to the tracks. Thus, it is possible to appropriately vary plural phrases being reproduced by means of the reproduction section in response to travel environments.

In a second aspect of the present invention, a music reproduction apparatus includes a vehicle status information input section for inputting vehicle status information representing the vehicle status, a travel environment information input section for inputting travel environment information representing a travel environment of a vehicle, a music data storage for storing music data, a music reproduction section for reproducing the music data, a setup value control section for controlling the setup values of reproduction parameters regarding the vehicle status information based on the travel environment information, and a reproduction parameter control section for controlling reproduction parameters based on the setup values controlled by the setup value control section and the vehicle status information.

In the above, since the music reproduction apparatus controls reproduction parameters based on both the vehicle status information and the travel environment information, when reproduction parameters of the music are varied in response to the vehicle status, it is possible to prevent the reproduced music from becoming unnatural to hear due to differences of travel environments.

The music reproduction apparatus further includes a selection section for selecting at least one music data from the music data storage, which stores a plurality of music data, based on the travel environment information, so that the music reproduction section reproduces the music data selected by the selection section.

This makes it possible for the music reproduction apparatus to reproduce music data suited to travel environments.

In a third aspect of the present invention, a music reproduction apparatus includes a reproduction section for repeatedly reproducing a phrase composed of at least one music reproduction unit, an external condition information input section for inputting external condition information representing an external condition, and a reproduction time length control section for controlling a reproduction time length of the music reproduction unit included in the phrase in response to the external condition information.

Since the reproduction time length of the phrase is varied in response to the external condition information, it is possible to reproduce phrases in various manners in response to the vehicle status and travel environments.

In the above, after completion of the reproduction of the music reproduction unit included in the phrase with the reproduction time length suiting the external condition information, it is possible for the reproduction time length control section to temporarily stop the reproduction and then to start reproducing the music reproduction unit included in the next phrase.

That is, it is possible to start reproducing the next phrase after the phrase is temporarily stopped in the middle of the reproduction thereof; hence, it is possible to realize the reproduction of the music having rich variations in response to the external condition.

Alternatively, the music reproduction apparatus includes a reproduction section having a plurality of tracks, in which a first track repeatedly reproduces a first phrase composed of one measure, and a second track repeatedly reproduces a second phrase composed of a plurality of measures, an external condition information input section for inputting the external condition information representing the external condition, and a reproduction time length control section for controlling a reproduction time length of the first phrase reproduced by the first track in response to the external condition information, wherein the reproduction time length control section controls the reproduction section to start reproducing the measures included in the second phrase reproduced by the second track at the reproduction end timing of the first phrase.

Thus, it is possible to synchronize the reproduction start timing of the music reproduction unit corresponding to one phrase reproduced by the first track with the reproduction start timing of plural measures included in the phrase reproduced by the second track; hence, it is possible to realize the reproduction of the music having rich variations in response to the external condition information.

In a fourth aspect of the present invention, the music reproduction apparatus further includes a travel environment information input section for inputting travel environment information representing travel environments of a vehicle, a transmitter for transmitting the travel environment information to a server, a receiver for receiving a music file, which is selected in the server in response to the travel environment information and which includes the reproduction parameters, and a vehicle status information detection section for detecting the vehicle status so as to output the vehicle status information, wherein the reproduction section reproduces a musical tune based on the music file that is controlled in response to reproduction parameters, which are set in advance in correspondence with the vehicle status information.

In the above, the transmitter transmits the reproduction record of musical tunes, which are repeatedly reproduced by the reproduction section, to the server, in which the music file and reproduction parameters stored in correspondence with the vehicle status information are updated based on the reproduction record.

As described above, the server stores reproduction parameters in correspondence with music data and vehicle status information of vehicles (or mobile devices) with respect to travel environments, wherein it selects music data to be reproduced in response to travel environment information transmitted from the music reproduction apparatus installed in a vehicle, so that it reads the corresponding reproduction parameters so as to transmit a music file to the music reproduction apparatus. The music reproduction apparatus reproduces music data selected in response to the travel environment information so as to appropriately perform reproduction control in response to the vehicle status information. Thus, it is possible to vary a musical tune being reproduced following variations of the present position of a vehicle as well as the vehicle status and travel environments. In this case, the music reproduction apparatus is designed to receive music data from the server; hence, it is possible to autonomously reproduce a musical tune in response to the vehicle status without preparing music data in advance.

DESCRIPTION OF THE PREFERRED EMBODIMENTS

The present invention will be described in further detail by way of embodiments with reference to the accompanying drawings.

1. First Embodiment

Figure 1A:
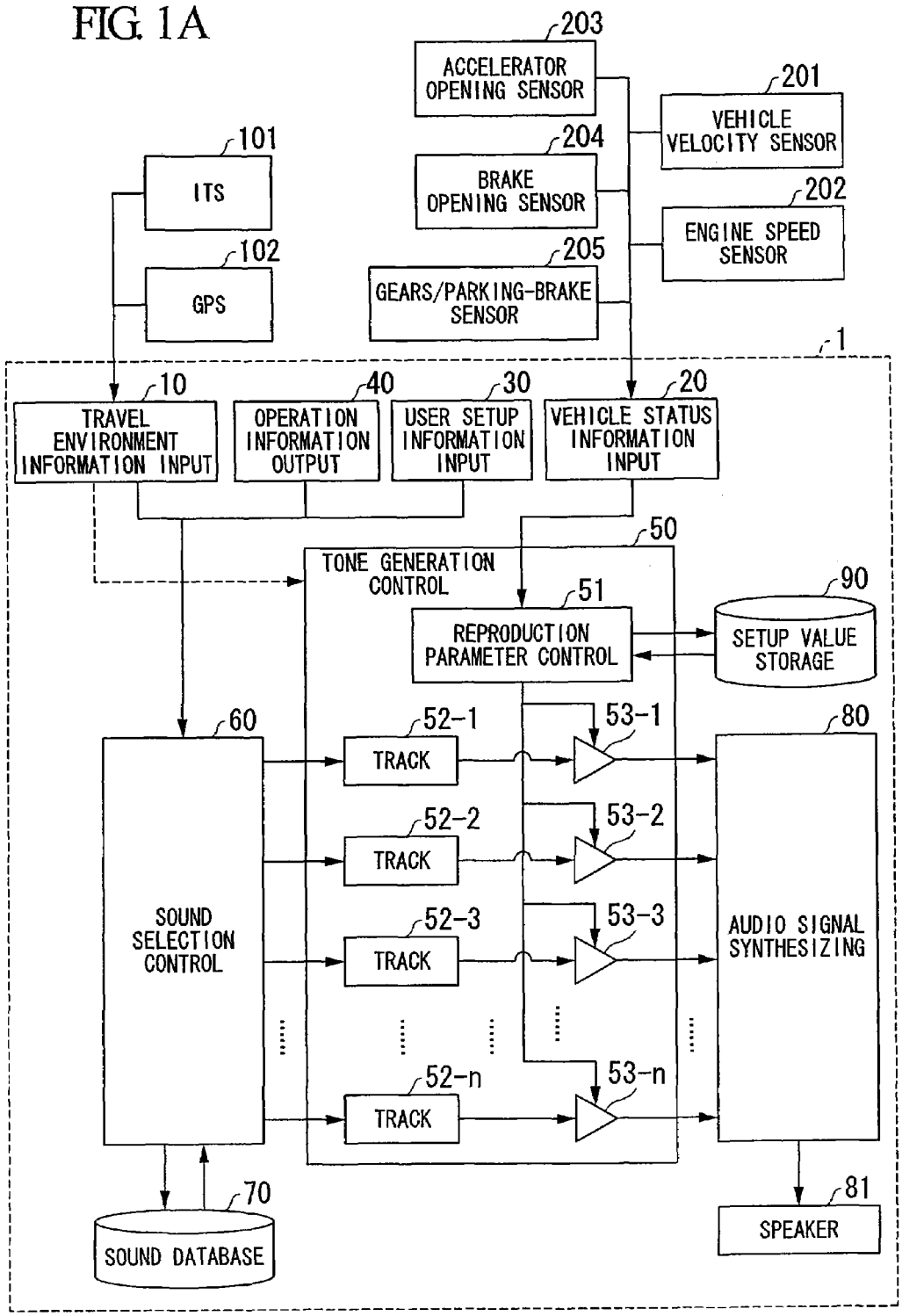
FIG. 1A is a block diagram showing the basic constitution of a music reproduction apparatus in accordance with first to fourth embodiments of the present invention.

FIG. 1A is a block diagram showing the basic constitution of a music reproduction apparatus 1 according to a first embodiment of the present invention. The music reproduction apparatus 1 shown in FIG. 1A includes a travel environment information input section 10, a vehicle status information input section 20, a user setup information input section 30, an operation information output section 40 indicating the operating conditions of various operation switches, a tone generation control section 50, a sound selection control section 60, a sound database 70, an audio signal synthesizing section 80, a speaker 81, and a setup value storage 90.

The music reproduction apparatus 1 installed in a vehicle is capable of simultaneously reproducing plural kinds of musical tunes composed of phases representing various sounds such as drum loops (sounds of drums and percussion, or series of sounds mixing sampling sounds of percussion) and soundscape elements (i.e., acoustic environments such as sounds of waves and songs of birds) by use of the speaker 81 installed in the vehicle. The music reproduction apparatus 1 inputs vehicle status information representing a vehicle status from sensors attached to various positions of the vehicle so as to independently control reproduction parameters in units of types of phrases.

Next, functions of the music reproduction apparatus 1 for realizing independent control of reproduction parameters will be described in detail.

The vehicle status information input section 20 is connected to various sensors for sensing a vehicle status so as to input vehicle status information representing the vehicle status detected by the sensors and to output it to the tone generation control section 50. Specifically, the vehicle status information input section 20 is connected to a velocity sensor 201, an engine speed sensor 202, an accelerator opening sensor 203, a brake opening sensor 204, and a gears/parking-brake sensor 205.

The velocity sensor 201 detects a travel velocity of a vehicle. The engine speed sensor 202 detects the engine speed of the vehicle. The accelerator opening sensor 203 detects an accelerator opening or an accelerator depression. The vehicle status information input section 20 inputs the vehicle status information including various pieces of information detected by the aforementioned sensors so as to output it to the tone generation control section 50.

The travel environment information input section 10 inputs travel environment information representing a travel environment of a vehicle so as to output it to the sound selection control section 60. The travel environment information input section 10 is connected to an Intelligent Transport System (ITS) 101 and a Global Positioning System (GPS) 102. The ITS 101 receives various pieces of information regarding road traffics (e.g., weather information, traffic jam information, speed limit information, road condition information, regional information, time information, etc.) from a road network surveillance center (not shown), so that the travel environment information input section 10 inputs various pieces of information received by the ITS 101. The GPS 102 receives radio wave signals including time data transmitted from plural GPS satellites and calculates differences of distances from GPS satellites based on differences of arrival times of received radio wave signals, thus specifying the position of a vehicle on the earth based on the principle of triangulation. The travel environment information input section 10 inputs position information (i.e., longitude-latitude information) of a vehicle specified by the GPS 102. The travel environment information input section 10 inputs the travel environment information including various pieces of information described above, thus outputting it to the sound selection control section 60.

The music reproduction apparatus 1 is equipped with various operation switches (not shown) including a switch that allows the user to designate sound output and mute. The operation information output section 40 detects operation conditions of operation switches so as to output operation information to the sound selection control section 60.

The vehicle is equipped with an onboard audio system other than the music reproduction apparatus 1; hence, the user is capable of setting it up so as to output only the sound of the onboard audio system, to output only the sound of the music reproduction apparatus 1, or to simultaneously output both sounds. For this reason, the vehicle is equipped with a user setup section (not shown). The user setup information input section 30 inputs user setup information (i.e., information instructing whether or not to output phrases) created by the user setup section so as to output it to the sound selection control section 60.

The tone generation control section 50 has a plurality of tracks 52 (i.e., 52-1, 52-2, . . . , **52-*n*, where n is an integer that is two or more), which input and reproduce different types of phrases (i.e., audio data). The tracks 52 produce audio signals based on input phrases so as to output them as phrase signals. The tone generation control section 50 cooperates with the audio signal synthesizing section 80 so as to reproduce a plurality of phrases in accordance with a prescribed reproduction parameter, which is controlled by each of the tracks 52, (i.e., at least one of the volume, pitch, tempo, tone color, and tone-generation timing, wherein the following description is made in such a way that the reproduction parameter designates the volume). Details of processing of the tone generation control section 50** will be described below.

The audio signal synthesizing section 80 inputs and synthesizes audio signals (i.e., phrase signals), which are produced based on phrases reproduced by the tracks 52, and then it produces and outputs synthesized phrase signals to the speaker 81. The speaker 81 reproduces sounds based on the synthesized phrase signals.

The sound database 70 stores a plurality of different types of phrases. The sound database 70 stores phrases as audio data of a sound file format composed of various parameters (including sound waveforms) used for the sound synthesis.

The sound selection control section 60 selects a desired phrase from among plural phrases stored in the sound database 70 so as to assign it to the track 52. The track 52 reproduces the phrase, which is assigned thereto by means of the sound selection control section 60.

Next, a phrase selection method of the sound selection control section 60 will be described. The sound selection control section 60 extracts a phrase having a time length of several minutes from the sound database 70 on the basis of the travel environment information input by the travel environment information input section 10, thus assigning it to the track 52. Specifically, storage (not shown) installed in the sound selection control section 60 stores a selection table for storing the correspondence between the travel environment information and at least one phrase being selected. With reference to the selection table, the sound selection control section 60 selects at least one phrase in correspondence with the input travel environment information.

The sound selection control section 60 controls the assignment of phrases to the tracks 52 based on the operation information output from the operation information output section 40 and the user setup information output from the user setup information input section 30. Specifically, when the user operates a switch so as to produce operation information designating a mute instruction, the sound selection control section 60 does not assign the corresponding phrases to the tracks 52. In addition, when the user setup information instructs not outputting phrases, the sound selection control section 60 does not assign the phrases to the tracks 52.

Next, a concrete example of the phrase selection method executed by the sound selection control section 60 will be described. Herein, the selection table stores phrases in correspondence with time information (designating the year, month, and day), weather information, and position information. The contents of the selection table are determined in advance in such a way that phrases are appropriately selected in response to the season, morning, noon, and night, the weather information such as fine, rain, and snow, and road types such as urban roads and speedways.

In addition, the contents of the selection table are determined in advance in such a way that phrases suiting present regional areas (e.g., phrases suiting residential areas, phrases suiting downtowns, and phrases suiting seaside towns) are appropriately selected. Furthermore, the contents of the selection table are determined in advance in such a way that special phrases suiting special days are selected at special days such as the New Year's Day and Christmas. Special days may include birthdays of drivers of vehicles and companions sharing the same vehicles. The sound selection control section 60 extracts phrases, which are stored in the selection table in correspondence with time information, weather information, and position information, from the sound database 70.

Next, the processing of the tone generation control section 50 will be described in detail. The tone generation control section 50 includes a reproduction parameter control section 51, a plurality of tracks 52, and a plurality of amplifiers 53 arranged in connection with the tracks 52. The amplifiers 53 amplify phrase signals output from the corresponding tracks 52 so as to output them to the audio signal synthesizing section 80, wherein amplification factors thereof are controlled by the reproduction parameter control section 51.

The reproduction parameter control section 51 controls reproduction parameters (e.g., volumes) in response to the vehicle status information supplied from the vehicle status information input section 20 with respect to the tracks 52. That is, the reproduction parameter control section 51 controls amplification factors of the amplifiers 53 in response to the vehicle status information. The setup value storage 90 stores setup values representing variations of reproduction parameters related to the vehicle status information with respect to plural types of phrases. The reproduction parameter control section 51 reads the setup values, which are stored in the setup value storage 90, based on the vehicle status information supplied from the vehicle status information input section 20, thus controlling reproduction parameters based on the read setup values with respect to the tracks 52. The audio signal synthesizing section 80 synthesizes phrase signals whose reproduction parameters are controlled so as to produce synthesized phrase signals, which are then supplied to the speaker 81 so as to produce the corresponding sound.

It is possible for the setup value storage 90 to have a setup value table, which stores the setup values in correspondence with vehicle status information. Alternatively, it is possible for the setup value storage 90 to store functions representing the relationships between the setup values and vehicle status information. It is preferable that the setup values stored in the setup value storage 90 be directly determined in correspondence with vehicle status information. For example, when the vehicle status information designates a velocity, it is preferable that the setup values be directly determined in correspondence with vehicle velocities detected by the velocity sensor 201.

Figure 2:
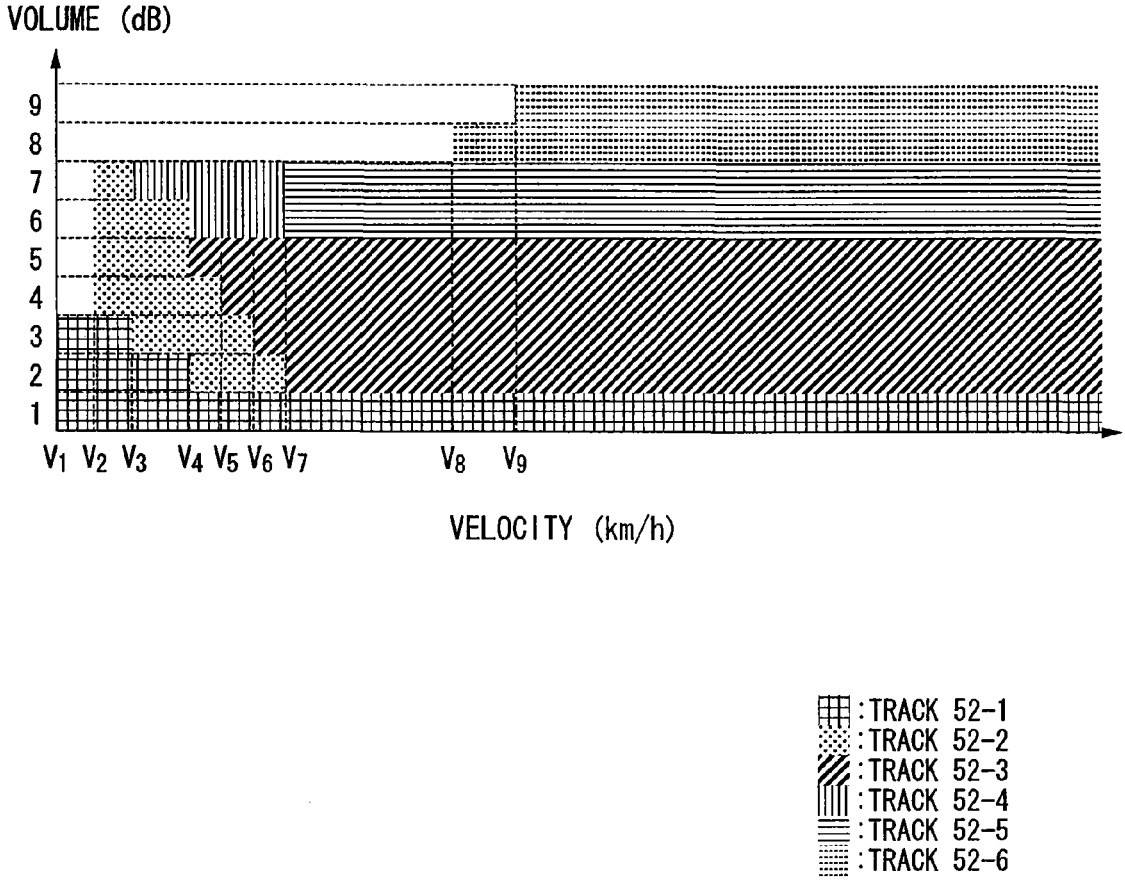
FIG. 2 is a graph showing the relationship between the volume and velocity with respect to plural phrases being reproduced by plural tracks included in the music reproduction apparatus.

FIG. 2 is a graph showing the relationship between the volume and velocity with respect to plural phrases being reproduced by the plural tracks 52. Specifically, it shows the relationship between the volume (ranging from 1 dB to 9 dB) and the velocity (ranging from $V_1$ to $V_9$) with respect to six phrases S1 to S6 being reproduced by the six tracks 52-1 to 52-6.

In FIG. 2, within a velocity range from $V_1$ to $V_2$, the phrase S1 is reproduced by the track 52-1 at 3 dB in volume, while other phrases are each set to 0 dB in volume and are not reproduced.

Within a velocity range from $V_2$ to $V_3$, the phrase S1 is reproduced at 3 dB in volume, and the phrase S2 is further reproduced at 4 dB in volume by means of the track 52-2. Other phrases are each set to 0 dB in volume and are not reproduced. At this time, a synthesized phrase signal synthesizing the phrases S1 and S2 is set to 7 dB in volume.

Within a velocity range from $V_3$ to $V_4$, the phrase S1 is reproduced at 2 dB in volume; the phrase S2 is reproduced at 4 dB in volume; and the phrase S4 is further reproduced at 1 dB in volume by means of the track 52-4. Other phrases are each set to 0 dB in volume and are not reproduced. At this time, a synthesized phrase signal synthesizing the phrases S1, S2, and S4 is set to 7 dB in volume.

Within a velocity range from $V_4$ to $V_5$, the phrase S1 is reproduced at 1 dB in volume; the phrase S2 is reproduced at 3 dB in volume; the phrase S4 is reproduced at 2 dB in volume; and the phrase S3 is reproduced at 1 dB in volume by means of the track 52-3. Other phrases are each set to 0 dB in volume and are not reproduced. At this time, a synthesized phrase signal synthesizing the phrases S1, S2, S3, and S4 is set to 7 dB in volume.

Within a velocity range from $V_5$ to $V_6$, the phrase S1 is reproduced at 1 dB in volume; the phrase S2 is reproduced at 2 dB in volume; the phrase S3 is reproduced at 2 dB in volume; and the phrase S4 is reproduced at 2 dB in volume; but other phrases are each set to 0 dB in volume and are not reproduced. At this time, a synthesized phrase signal synthesizing the phrases S1, S2, S3, and S4 is set to 7 dB in volume.

Within a velocity range from $V_6$ to $V_7$, the phrase S1 is reproduced at 1 dB in volume; the phrase S2 is reproduced at 1 dB in volume; the phrase S3 is reproduced at 3 dB in volume; and the phase S4 is reproduced at 2 dB in volume; but other phrases are each set to 0 dB in volume and are not reproduced. At this time, a synthesized phrase signal synthesizing the phrases S1, S2, S3, and S4 is set to 7 dB in volume.

Within a velocity range from $V_7$ to $V_8$, the phrase S1 is reproduced at 1 dB in volume; the phrase S3 is reproduced at 4 dB in volume; and the phrase S5 is reproduced at 2 dB in volume by means of the track 52-5. Other phrases including the phrases S2 and S4 are each set to 0 dB in volume and are not reproduced. At this time, a synthesized phrase signal synthesizing the phrases S1, S3, and S5 is set to 7 dB in volume.

Within a velocity range from $V_8$ to $V_9$, the phrase S1 is reproduced at 1 dB in volume; the phrase S3 is reproduced at 4 dB in volume; the phrase S5 is reproduced at 2 dB in volume; and the phrase S6 is reproduced at 1 dB in volume by means of the track 52-6. Other phrases are each set to 0 dB in volume and are not reproduced. At this time, a synthesized phrase signal synthesizing the phrases S1, S3, S5, and S6 is set to 8 dB in volume.

For a velocity of $V_9$ or higher, the phrase S1 is reproduced at 1 dB in volume; the phrase S3 is reproduced at 4 dB in volume; the phrase S5 is reproduced at 2 dB in volume; and the phrase S6 is reproduced at 2 dB in volume; but other phrases are each set to 0 dB in volume and are not reproduced. At this time, a synthesized phrase signal synthesizing the phrases S1, S3, S5, and S6 is set to 9 dB in volume.

Figure 3:
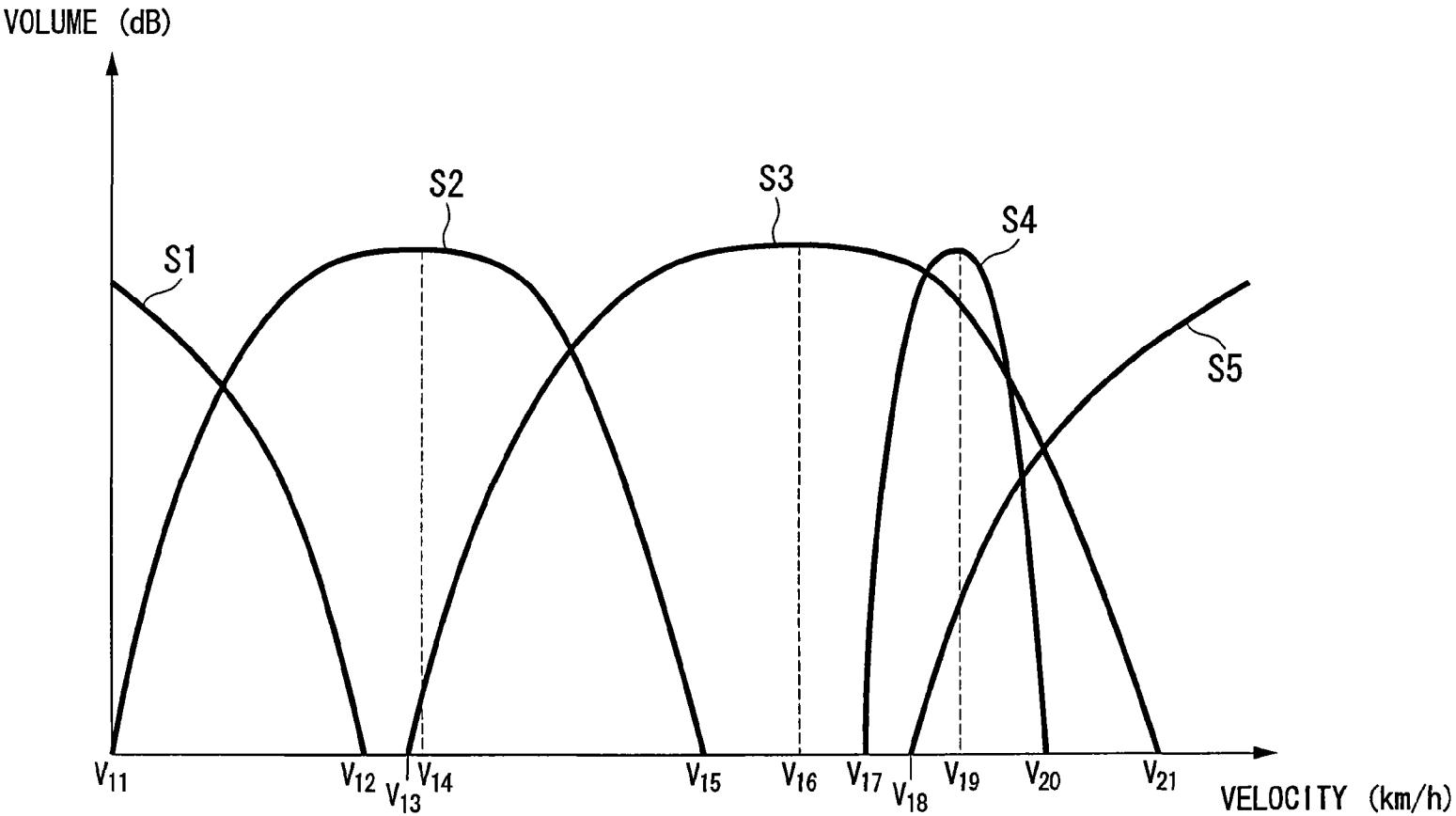
FIG. 3 is a graph showing the relationship between the volume and velocity in respect of the reproduction of soundscape phrases.

FIG. 3 is a graph showing the relationship between the volume and velocity in respect of the reproduction of sound-scape phrases. At velocity $V_{11}$, the sound-scape phrase S1 has a high volume, while other sound-scape phrases are each set to 0 dB in volume. As the velocity increases to higher than $V_{11}$, the sound-scape phrase S2 increases in volume, but the sound-scape phrase S1 gradually decreases in volume and is then set to 0 dB at velocity $V_{12}$. As the velocity further increases to higher than $V_{13}$, the sound-scape phrase S3 starts to gradually increase in volume; when the velocity reaches $V_{14}$, the sound-scape phrase S2 starts to gradually decrease in volume; then, the sound-scape phrase S2 is set to 0 dB in volume at velocity $V_{15}$.

The sound-scape phrase S3 increases in volume as the velocity increases up to $V_{16}$; then, it gradually decreases in volume. At velocity $V_{17}$ or higher, the sound-scape phrase S4 rapidly increases in volume and then reaches a maximum value in volume at velocity $V_{19}$. At velocity $V_{18}$, the sound-scape phrase S5 starts to gradually increase in volume. After the sound-scape phrase S4 reaches a maximum value in volume, it rapidly decreases in volume, and then it is set to 0 dB in volume at velocity $V_{20}$. At velocity $V_{21}$, the sound-scape phrase S3 is set to 0 dB in volume.

The setup value storage 90 stores the setup values representing variations of volumes with respect to plural phrases with reference to the relationships between the volume and velocity, which are shown in FIGS. 2 and 3. The reproduction parameter control section 51 controls reproduction parameters based on the setup values with respect to the tracks 52, thus realizing the aforementioned variations of volumes.

It is possible for the setup value storage 90 to further store the setup values regarding other reproduction parameters representing variations of pitches and the like in addition to the aforementioned setup values representing variations of volumes. In this case, it is possible for the reproduction parameter control section 51 to simultaneously realize variations of pitches in addition to variations of volumes based on the aforementioned setup values.

Next, the processing of the music reproduction apparatus 1 will be described with reference to a flowchart shown in FIG. 4.

Figure 4:
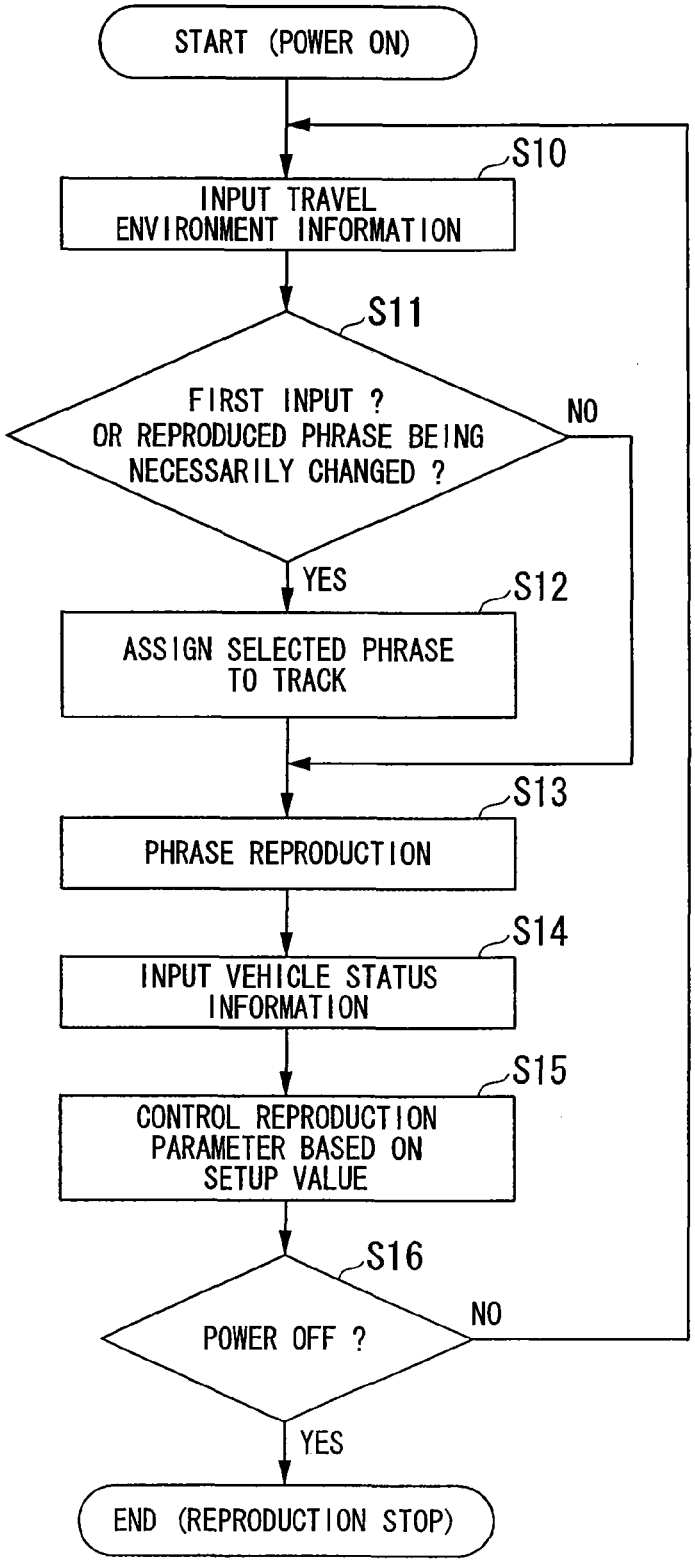
FIG. 4 is a flowchart showing the processing of the music reproduction apparatus.

FIG. 4 is a flowchart showing the processing of the music reproduction apparatus 1. When a power switch (not shown) is turned on so that the music reproduction apparatus 1 is started up in processing, the flow proceeds to step S10, in which the travel environment information input section 10 inputs travel environment information. Next, the flow proceeds to step S11, in which the music reproduction apparatus 1 makes a decision as to whether or not the input travel environment information is first one after the start-up is input thereto, so that it selects a phrase to be reproduced based on the input travel environment information. Furthermore, the music reproduction apparatus 1 makes a decision as to whether or not the phrase to be reproduced differs from the presently reproducing phrase.

In step S11, when it is determined that the input travel environment information is the first one after the start-up, or when it is determined that the phrase to be reproduced differs from the phrase that is presently being reproduced, the flow proceeds to step S12 in which the music reproduction apparatus 1 assigns the selected phrases to the tracks 52. In step S11, when it is determined that the input travel environment information is not the first one after the start-up, and when it is determined that the phrase to be reproduced matches the phrase that is presently being reproduced, the music reproduction apparatus 1 skips step S12 so that the flow proceeds to step S13. In step S13, the music reproduction apparatus 1 reproduces the phrases assigned to the tracks 52.

Next, the flow proceeds to step S14 in which the vehicle status information input section 20 inputs vehicle status information by means of the aforementioned sensors 201 to 205. Next, the flow proceeds to step S15 in which the setup values regarding reproduction parameters are read from the setup value storage 90 based on the input vehicle status information, so that the music reproduction apparatus 1 controls the reproduction parameters of the tracks 52 based on the read setup values. In step S16, a decision is made as to whether or not the power switch is turned off. Thus, until the power switch is turned off, the music reproduction apparatus 1 repeatedly executes the aforementioned steps S10 to S15.

As described above, when the music reproduction apparatus 1 of the first embodiment reproduces plural types of phrases, it is possible to independently control reproduction parameters (i.e., at least one of the volume, pitch, tempo, tone color, and tone-generation timing) in response to the vehicle status with respect to the types of phrases. This makes it possible to simultaneously generate musical tones in various patterns, thus allowing the listener to enjoy music while experiencing variations of the vehicle status. In reproduction of sound-scape phrases, it is possible to change over sound-scape sources in response to the vehicle status, wherein no discontinuity or no break occurs in sound before and after the changeover. That is, it is possible to realize reproduction of sound-scape phrases being naturally varied. In addition, it is possible to store control methods of reproduction parameters as the setup values in advance with respect to the types of phrases. Furthermore, even when the vehicle status continuously varies, it is possible to continuously control reproduction parameters.

In this connection, the music reproduction apparatus 1 is capable of appropriately changing plural phrases being reproduced by means of the tracks 52.

2. Second Embodiment

Next, a music reproduction apparatus according to a second embodiment of the present invention will be described. The basic constitution of the second embodiment is similar to that of the first embodiment shown in FIG. 1A; hence, it will be described with reference to FIG. 1A. That is, the music reproduction apparatus 1 according to the second embodiment is constituted of the travel environment information input section 10 connected to the ITS 101 and the GPS 102, the vehicle status information input section 20 connected to various sensors, the user setup information input section 30, the tone generation control section 50, the sound selection control section 60, the sound database 70, and the setup value storage 90. As shown by an arrow of a dotted line, the travel environment information output from the travel environment information input section 10 is supplied to the tone generation control section 50. Furthermore, it is possible for the tone generation control section 50 to further include a setup value control section and a music reproduction section (not shown) in addition to the reproduction parameter control section 51.

In the second embodiment, the sound database 70 functions as a music data storage. That is, the music data storage 70 stores a plurality of music data; hence, it is possible for the music reproduction section included in the tone generation control section 50 to reproduce music data.

The user setup information input section 30 reads music data designated by the user from digital storage media (not shown) so as to store them in the music data storage 70. In this case, the user setup information input section 30 is directly connected to the music data storage 70. The user setup information input section 30 outputs user setup information representing user's selection of music data to the sound selection control section 60.

The sound selection control section 60 selects music data, which is stored in the music data storage 70, based on the travel environment information output from the travel environment information input section 10. Upon reception of the user setup information from the user setup information input section 30, the sound selection control section 60 extracts music data selected by the user from the music data storage 70. The sound selection control section 60 assigns the selected music data to the tracks 52.

Figure 5:
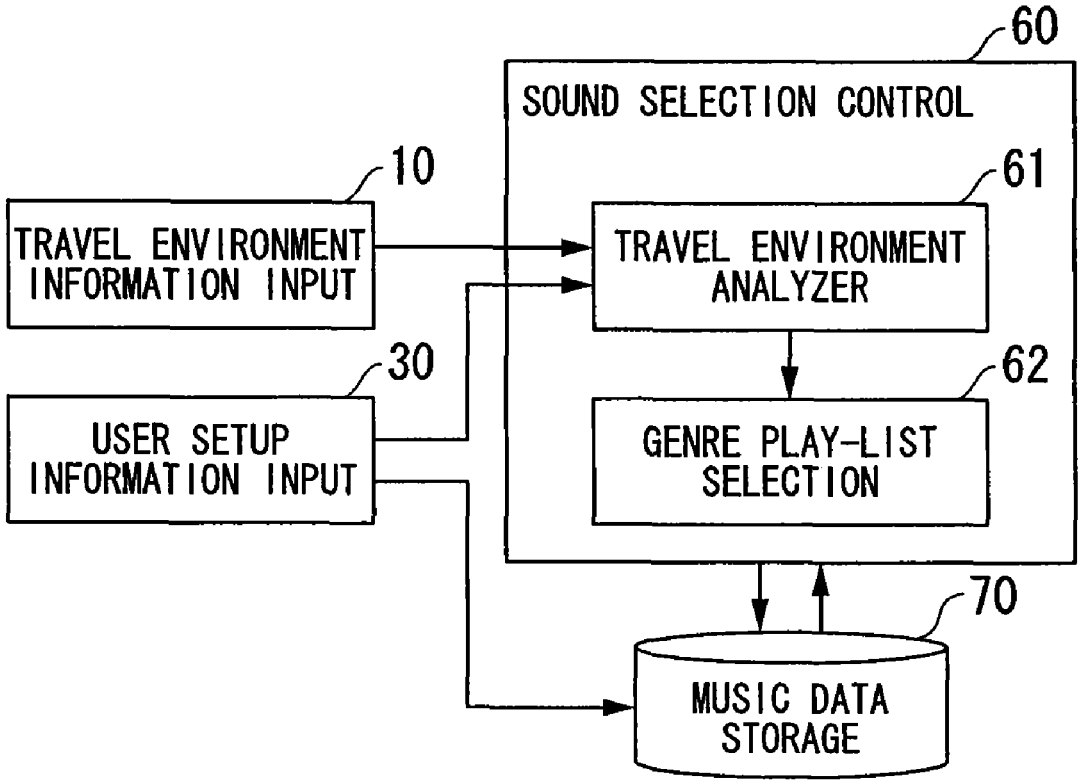
FIG. 5 is a block diagram showing the internal constitution of a sound selection control section included in the music reproduction apparatus of the second embodiment.

FIG. 5 is a block diagram showing the internal constitution and processing of the sound selection control section 60. That is, the sound selection control section 60 includes a travel environment analysis section 61 and a genre play-list selection section 62.

The travel environment analysis section 61 analyzes the travel environment information output from the travel environment information input section 10 so as to extract detailed information included in the travel environment information. As detailed information, it is possible to list weather information, congestion information, speed limit information, road condition information, regional information, time information (including year, month, and day), and position information.

The music data storage 70 stores genres (e.g., classics, pops, etc.), which music data belong to, as well. The music data storage 70 stores play lists, each representing a plurality of titles of music data, which the user selects in advance, as well. The genre play-list selection section 62 selects a genre or a play list based on the analysis result (i.e., the detailed information extracted from the travel environment information) of the travel environment analysis section 61. When a genre is selected, a plurality of music data belonging to the genre are sequentially selected in a prescribed order (e.g., a random order) and are then sequentially written into the tracks 52. When a play list is selected, a plurality of music data belonging to the play list is sequentially selected and is then sequentially written into the tracks 52.

Specifically, the music data storage 70 stores a table storing the correspondence between the combination of plural pieces of information, which are extracted by means of the travel environment analysis section 61, and the genre or the play list. Therefore, the genre play-list selection section 62 reads the genre or the play list, which is stored in correspondence with the combination of the extracted pieces of information, from the aforementioned table. As described above, the genre play-list selection section 62 selects the genre or the play list.

In FIG. 1A, the tone generation control section 50 controls reproduction parameters, which are used in a music reproduction mode, based on vehicle status information and travel environment information.

Specifically, the tone generation control section 50 controls the setup values of reproduction parameters, which are stored in correspondence with the vehicle status information, based on the travel environment information. The reproduction parameter control section 51 controls reproduction parameters to match the setup values, which are controlled as described above, based on the vehicle status information.

The setup value storage 90 stores the setup values of reproduction parameters in correspondence with the vehicle status information; hence, the tone generation control section 50 reads the setup values so as to modify at least a part of the read setup values based on the travel environment information. Thus, the tone generation control section 50 controls the setup values of reproduction parameters, which are stored in correspondence with the vehicle status information, based on the travel environment information.

Alternatively, it is possible for the setup value storage 90 to store the setup values of reproduction parameters in correspondence with the travel environment information. In this case, the tone generation control section 50 reads the setup values of reproduction parameters, which are stored in correspondence with the travel environment information, from the setup value storage 90 so as to supply them to the reproduction parameter control section 51. Thus, the tone generation control section 50 controls the setup values of reproduction parameters, which are stored in correspondence with the travel environment information, based on the vehicle status information.

Figure 6:
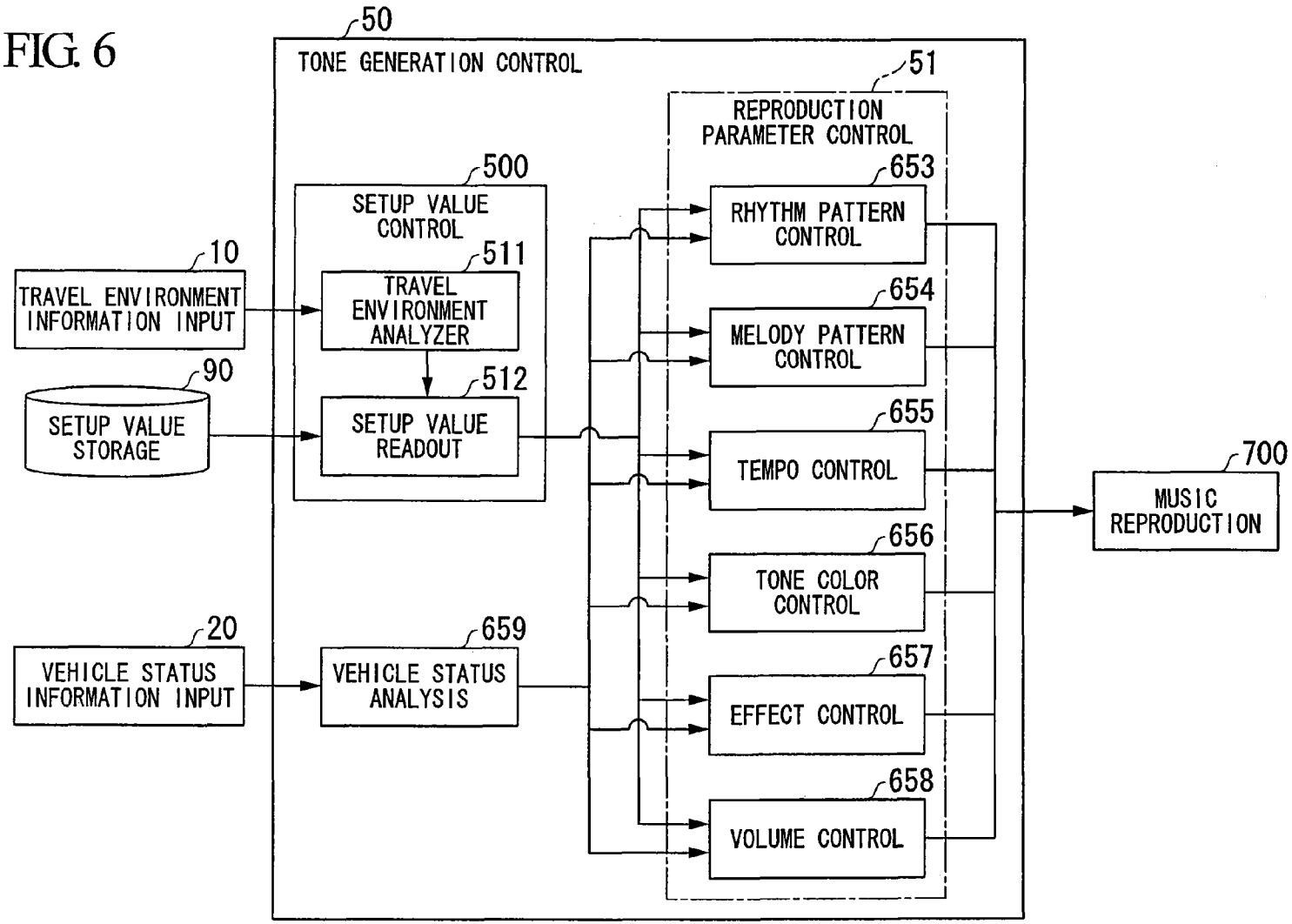
FIG. 6 is a block diagram showing the internal constitution of a tone generation control section included in the music reproduction apparatus of the second embodiment.

The details of the tone generation control section 50 will be described with reference to FIG. 6. The tone generation control section 50 includes a setup value control section 500, and a music reproduction section 700 is arranged independently of the tone generation control section 50.

Specifically, the reproduction parameter control section 51 includes a rhythm pattern control 653, a melody pattern control 654, a tempo control 655, a tone color control 656, an effect control 657, and a volume control 658. There is provided a vehicle status analyzer 659 in the tone generation control section 50. The setup value control section 500 includes a travel environment analyzer 511 and a setup value readout 512.

The travel environment analyzer 511 analyzes the travel environment information output from the travel environment information input section 10 so as to extract detailed information. As the detailed information, it is possible to list weather information, congestion information, speed limit information, road condition information, regional information, time information (including year, month, and day), and position information.

The setup value readout 512 reads the setup values of reproduction parameters, which are stored in correspondence with the vehicle status information, from the setup value storage 90 so as to modify at least a part of the read setup values based on the detailed information of the travel environment information extracted by the travel environment analyzer 511. Alternatively, it is possible for the setup value storage 90 to store the setup values of reproduction parameters in advance in correspondence with the detailed information of the travel environment information extracted by the travel environment analyzer 511. In this case, the setup value readout 512 reads out the setup values of reproduction parameters directly from the setup value storage 90. The read setup values are supplied to the rhythm pattern control 653, the melody pattern control 654, the tempo control 655, the tone color control 656, the effect control 657, and the volume control 658 in the reproduction parameter control section 51.

The vehicle status analyzer 659 analyzes the vehicle status information output from the vehicle status information input section 20 so as to extract detailed information included in the vehicle status information. As detailed information, it is possible to list the velocity, engine speed, accelerator opening, brake opening, gear ratio, engagement of a parking brake, etc. The extracted detailed information is supplied to the rhythm pattern control 653, the melody pattern control 654, the tempo control 655, the tone color control 656, the effect control 657, and the volume control 658 in the reproduction parameter control section 51. That is, the reproduction parameter control section 51 controls reproduction parameters in response to the setup values supplied from the setup value readout 512 and the detailed information of the vehicle status information output from the vehicle status analyzer 659 by means of the controls 653 to 658 of the reproduction parameter control section 51.

That is, the controls 653 to 658 included in the reproduction parameter control section 51 control music data reproduced by the music reproduction section 700 in response to setup values of reproduction parameters. Specifically, the rhythm pattern control 653 controls a rhythm pattern of music data; the melody pattern control 654 controls a melody pattern of music data; the tempo control 655 controls a tempo of music data; the tone color control 656 controls a tone color of music data; the effect control 657 controls an effect of music data; and the volume control 658 controls a volume of music data.

Next, the processing executed by the setup value readout 512 will be described in further detail with reference to FIGS. 7 to 13.

Figure 7:
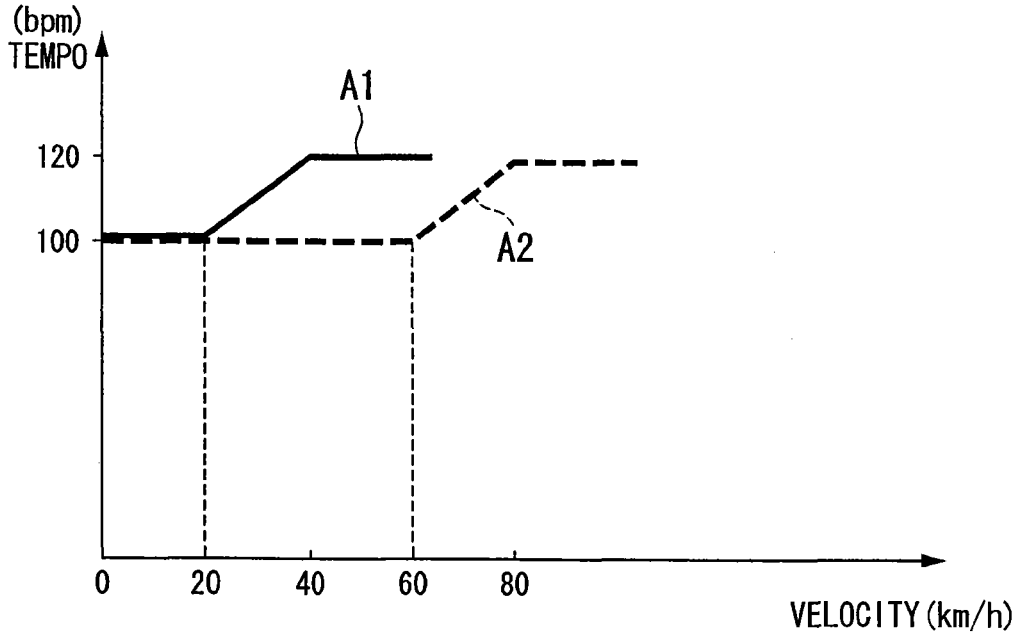
FIG. 7 is a graph showing the relationship between the tempo and velocity in a music reproduction mode.

FIG. 7 is a graph showing the relationship between the setup value of tempo and the velocity in connection with the speed limit. According to the graph of FIG. 7, the setup value of a tempo, which is stored in the setup value storage 90 in correspondence with the velocity, is set to 100 bpm (beats per minute) when the velocity is under V km/h; it is set to (velocity)+(100−V) bpm when the velocity ranges from V km/h to V+20 km/h; and it is set to 1200 bpm when the velocity is above V+20 km/h.

The setup value readout 512 changes the velocity V km/h (i.e., the velocity at the timing when the tempo starts to increase, wherein V is an integer) based on the speed limit that the travel environment analyzer 511 extracts from the travel environment information. Specifically, V=20 is set in the case of the speed limit of 60 km/h. A tempo-velocity characteristic A1 shown in FIG. 7 is drawn in the case of the speed limit of 60 km/h, wherein the tempo is set to 100 bpm when the velocity is under 20 km/h; the tempo is set to (velocity)+80 bpm when the velocity ranges from 20 km/h to 40 km/h; and the tempo is set to 120 bpm when the velocity ranges from 40 km/h to 60 km/h. A tempo-velocity characteristic A2 shown in FIG. 7 is drawn with respect to the speed limit of 100 km/h, wherein the tempo is set to 100 bpm when the velocity is under 60 km/h; the tempo is set to (velocity)+40 bpm when the velocity ranges from 60 km/h to 80 km/h; and the tempo is set to 120 bpm when the velocity ranges from 80 km/h to 100 km/h.

Figure 8:
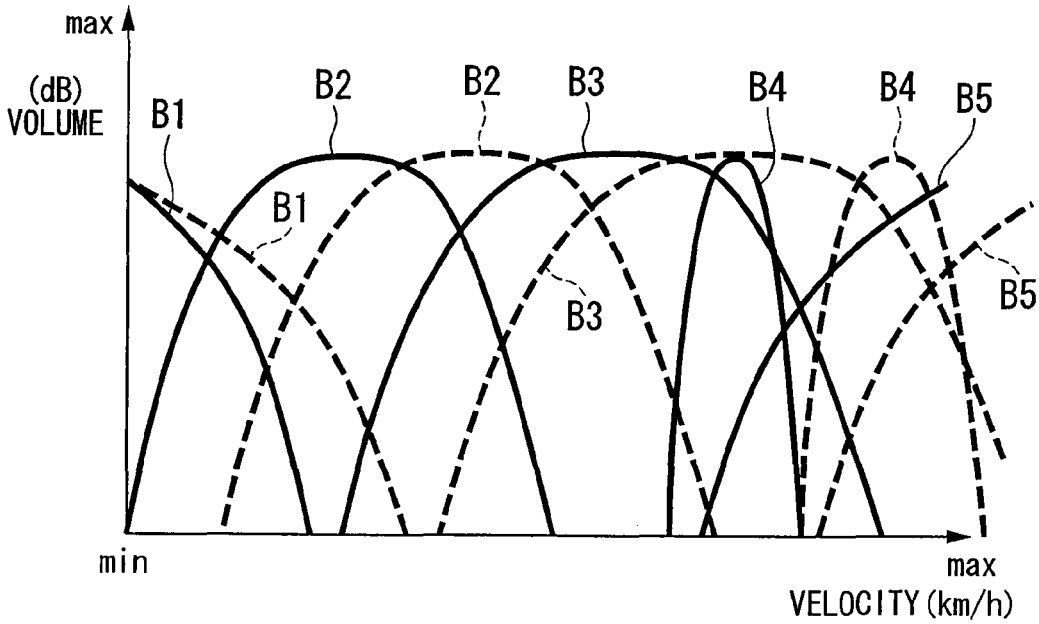
FIG. 8 is a graph showing the relationship between the volume and velocity in the music reproduction mode.

FIG. 8 is a graph showing the relationship between the setup value of volume and the velocity in connection with the speed limit. Herein, the relationship between the volume and velocity is shown when the music reproduction section 700 synthesizes and reproduces music data stored in plural tracks 52 (e.g., five tracks B1 to B5), each of which is independently controlled in volume by the tone generation control section 50. That is, the setup values of volumes stored in the setup value storage 90 are represented by relational expressions that use velocities as variables with respect to the tracks Bn (where n=1 to 5). The relational expression is defined in such a way that the velocity ranges between $Ve_0$ to $Ve_1$, and the maximum value of the volume is set to $Vo_{max}$. For example, the relational expression is expressed as "volume=$(-4Vo_{max}/(Ve_0-Ve_1)^2)\times(\text{velocity}-(Ve_0+Ve_1)/2)^2+Vo_{max}$" when $Ve_0 \leqq \text{velocity} < Ve_1$, while volume=0 when velocity<$Ve_0$ and $Ve_1 \leqq$ velocity.

The setup value readout 512 controls the volume of each track Bn in accordance with the aforementioned relational expression based on the speed limit extracted by the travel environment analyzer 511. In the case of the aforementioned relational expression, $Ve_0$ and $Ve_1$ are changed with respect to each track Bn. In the graph of FIG. 8, the setup values of the volume regarding the speed limit of 60 km/h are shown by solid curves, while the setup values of the volume regarding the speed limit of 100 km/h are shown by dotted curves. As shown in FIG. 8, the volume-velocity characteristic curves regarding the speed limit of 100 km/h are each shifted rightwards on the horizontal axis of the graph from the volume-velocity characteristic curves regarding the speed limit of 60 km/h.

Figure 9:
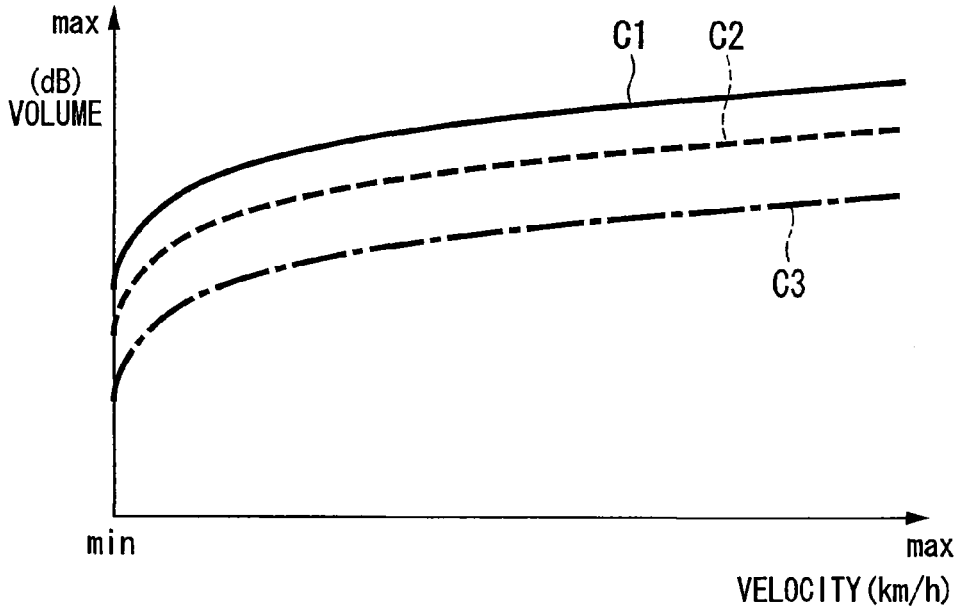
FIG. 9 is a graph showing the relationship between the relationship between the volume and velocity in the music reproduction mode in connection with weather parameters.

FIG. 9 shows the relationship between the setup value of the volume and the velocity in connection with the weather information and time information. The setup value storage 90 stores the setup values of the volume in accordance with the relational expression using the velocity as a variable. For example, the relational expression is defined as "volume=$\log_\beta$ (velocity+$\alpha$)+$\gamma$", where $\alpha$ and $\beta$ are positive constants, and $\gamma$ is a variable.

The setup value readout 512 controls the aforementioned relational expression based on the weather information and time information extracted by the travel environment analyzer 511. That is, the variable $\gamma$ is varied based on the weather information and time information. For example, a volume-velocity characteristic curve C1 corresponds to the condition of 5 p.m. in rainy weather; a volume-velocity characteristic curve C2 corresponds to the condition of 2 p.m. in fine weather; and a volume-velocity characteristic curve C3 corresponds to 11 p.m. in fine weather. The aforementioned curves C1, C2, and C3 are each controlled so as to be shifted along the vertical axis of the graph (i.e., in the direction in which the volume increases or decreases).

Figure 10:
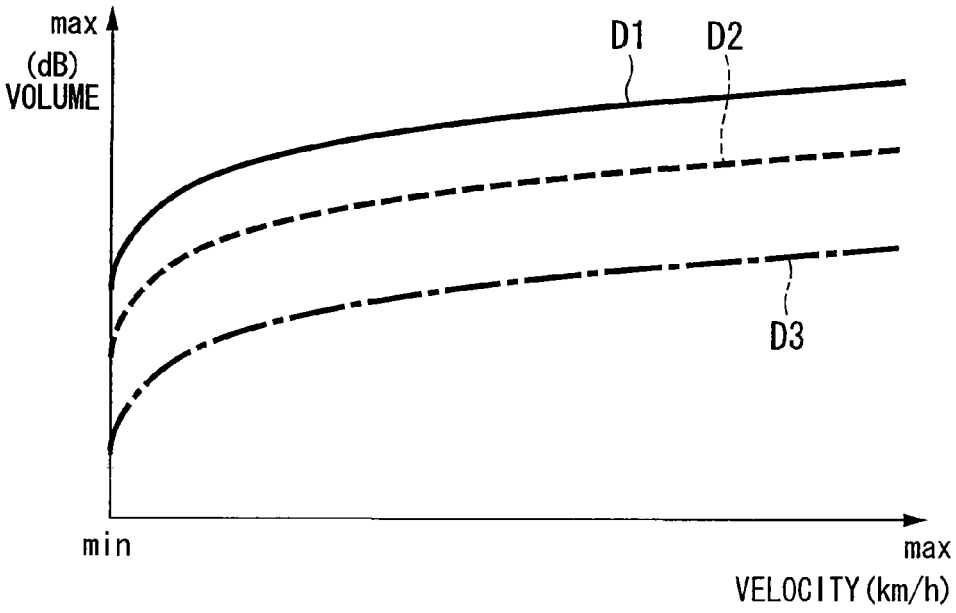
FIG. 10 is a graph showing the relationship between the volume and velocity in the music reproduction mode in connection with parameters regarding regional information of vehicle traveling.

FIG. 10 shows the relationship between the setup value of the volume and the velocity in connection with the regional information and the time information. Herein, the setup value storage 90 stores the setup values of the volume in accordance with the relational expression using the velocity as a variable. For example, the relational expression is defined as "volume=$\log_\beta$ (velocity+$\alpha$)+$\gamma$", where $\alpha$ and $\beta$ are positive constants, and $\gamma$ is a variable.

The setup value readout 512 controls the aforementioned relational expression based on the regional information and time information extracted by the travel environment analyzer 511. That is, the variable $\gamma$ is varied based on the regional information and time information. For example, a volume-velocity characteristic curve D1 corresponds to the condition of an urban district at 2 p.m.; a volume-velocity characteristic curve D2 corresponds to the condition of a residential area at 2 p.m.; and a volume-velocity characteristic curve D3 corresponds to the condition of a residential area at 11 p.m. The aforementioned curves D1, D2, and D3 are controlled so as to be shifted along the vertical axis of the graph (i.e., the direction in which the volume increases or decreases).

Figure 11:
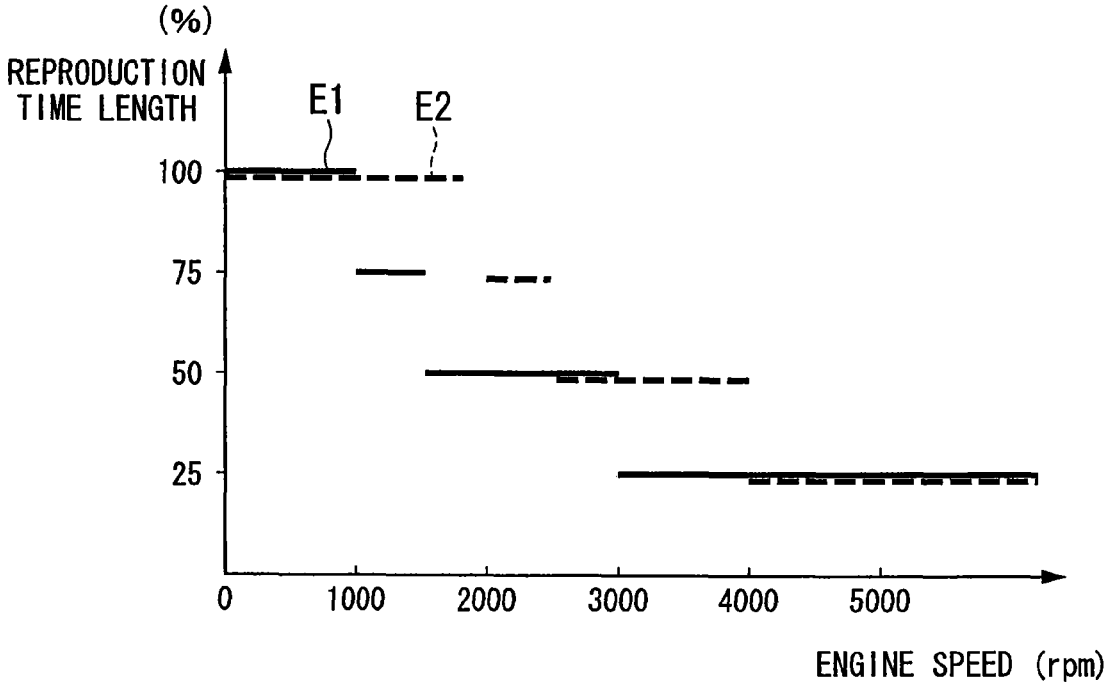
FIG. 11 is a graph showing the relationship between the wavelength and engine speed in the music reproduction mode.

FIG. 11 shows the relationship between the setup values of reproduction time lengths of musical tone waveforms and the engine speed in connection with road conditions. Music data stored in the music data storage 70 have constant time lengths, which are determined such that, even when a part is repeatedly reproduced, the sound should not become unnatural to hear, and which are determined to allow the listener to feel variations of reproduction velocity in response to time lengths (hereinafter, referred to as reproduction time lengths) of data portions subjected to repetitive reproduction. That is, the setup value of the reproduction time length, which the setup value storage 90 stores in correspondence with the engine speed, is expressed as a percentage to the time length of music data stored in the music data storage 70, wherein it is set to 100% when the engine speed is under 1000+R rpm (rounds per minute); it is set to 75% when the engine speed ranges from 1000+R rpm to 1500+R rpm; it is set to 50% when the engine speed ranges from 1500+R rpm to 3000+R rpm; and it is set to 25% when the engine speed is above 3000+R rpm.

The setup value readout 512 changes the offset value R rpm of the engine speed based on the road condition extracted by the travel environment analyzer 511. Specifically, the offset value R is set to 0 (i.e., R=0) when the road condition indicates small ups and downs; and it is set to 1000 (i.e., R=1000) when the road condition indicates large ups and downs. In FIG. 11, reproduction-time-length/engine-speed characteristics E1 shown by solid lines are drawn with respect to the road condition indicating small ups and downs, wherein the reproduction time length is set to 100% when the engine speed is under 1000 rpm; the reproduction time length is set to 75% when the engine speed ranges from 1000 rpm to 1500 rpm; the reproduction time length is set to 50% when the engine speed ranges from 1500 rpm to 3000 rpm; and the reproduction time length is set to 25% when the engine speed is above 3000 rpm. Reproduction-time-length/engine-speed characteristics E2 shown by dotted lines are drawn with respect to the road condition indicating large ups and downs, wherein the reproduction time length is set to 100% when the engine speed is under 2000 rpm; the reproduction time length is set to 75% when the engine speed ranges from 2000 rpm to 2500 rpm; the reproduction time length is set to 50% when the engine speed ranges from 2500 rpm to 4000 rpm; and the reproduction time length is set to 25% when the engine speed is above 4000 rpm.

Figure 12:
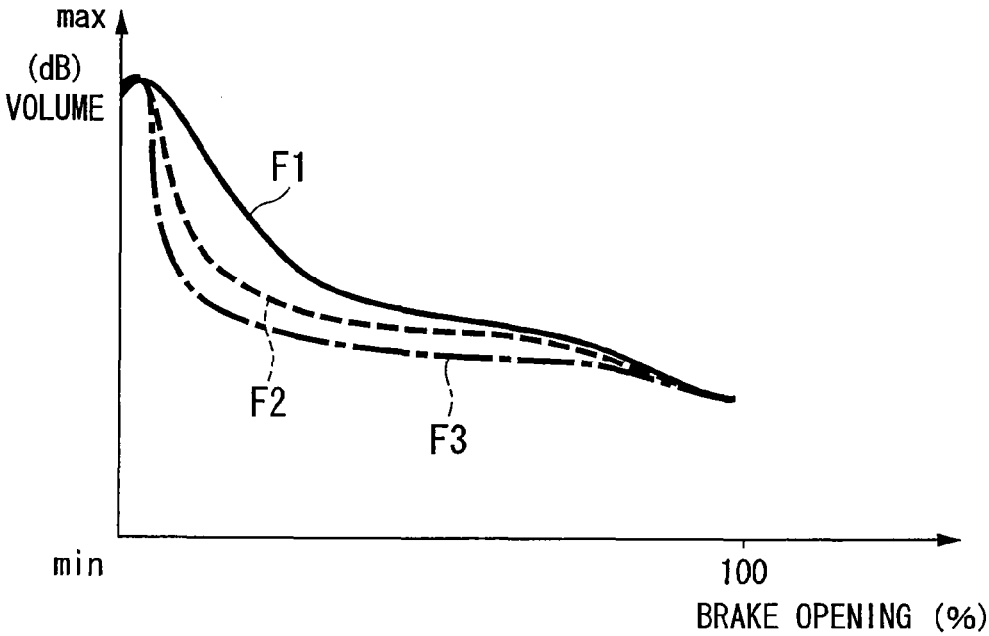
FIG. 12 is a graph showing the relationship between the volume and brake opening in the music reproduction mode.

FIG. 12 shows the relationship between the setup value of the volume and the brake opening in connection with the congestion information. Herein, the setup value storage 90 stores the setup values of volumes in accordance with a relational expression using the brake opening as a variable.

The setup value readout 512 controls the relational expression based on the congestion information extracted by the travel environment analyzer 511. That is, the setup value storage 90 stores different setup values (i.e., relational expressions) in correspondence with the congestion information in advance, so that the setup value readout 512 changes the relational expression when reading out the setup values in correspondence with the congestion information extracted by the travel environment analyzer 511.

In FIG. 12, a volume/brake-opening characteristic F1 indicates the condition of the normal traffic (i.e., no congestion); a volume/brake-opening characteristic F2 indicates the condition in which traffic is regulated due to road construction; and a volume/brake-opening characteristic F3 indicates the congested condition. As shown in FIG. 12, the characteristics F1, F2, and F3 show different variations of volumes in relation to brake openings.

Figure 13:
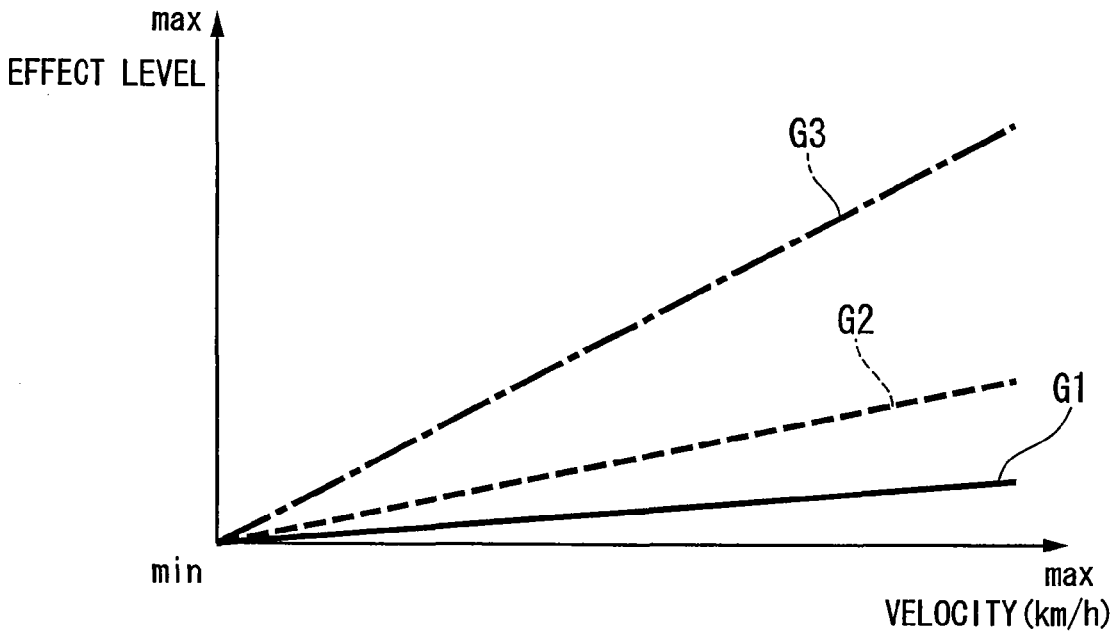
FIG. 13 is a graph showing the relationship between the effect level and velocity in the music reproduction mode.

FIG. 13 shows the relationship between the setup value of the effect level and the velocity in connection with the road condition. Herein, the setup value storage 90 stores the setup values of the effect level in accordance with the relational expression using the velocity as a variable. The relational expression is a linear function regarding the velocity, for example.

The setup value readout 512 controls the relational expression based on the road condition extracted by the travel environment analyzer 511. The slope of the linear function is changed based on the road condition. In FIG. 13, an effect-level/velocity characteristic G1 indicates a dry road condition; an effect-level/velocity characteristic G2 indicates the road condition in which slippery condition warning is issued due to rain; and an effect-level/velocity characteristic G3 indicates the road condition in which slippery condition warning is issued due to freezing. As shown in FIG. 13, the characteristics G1, G2, and G3 differ from each other with respect to their slope.

Next, the processing of the music reproduction apparatus 1 according to the second embodiment will be described with reference to a flowchart shown in FIG. 14.

Figure 14:
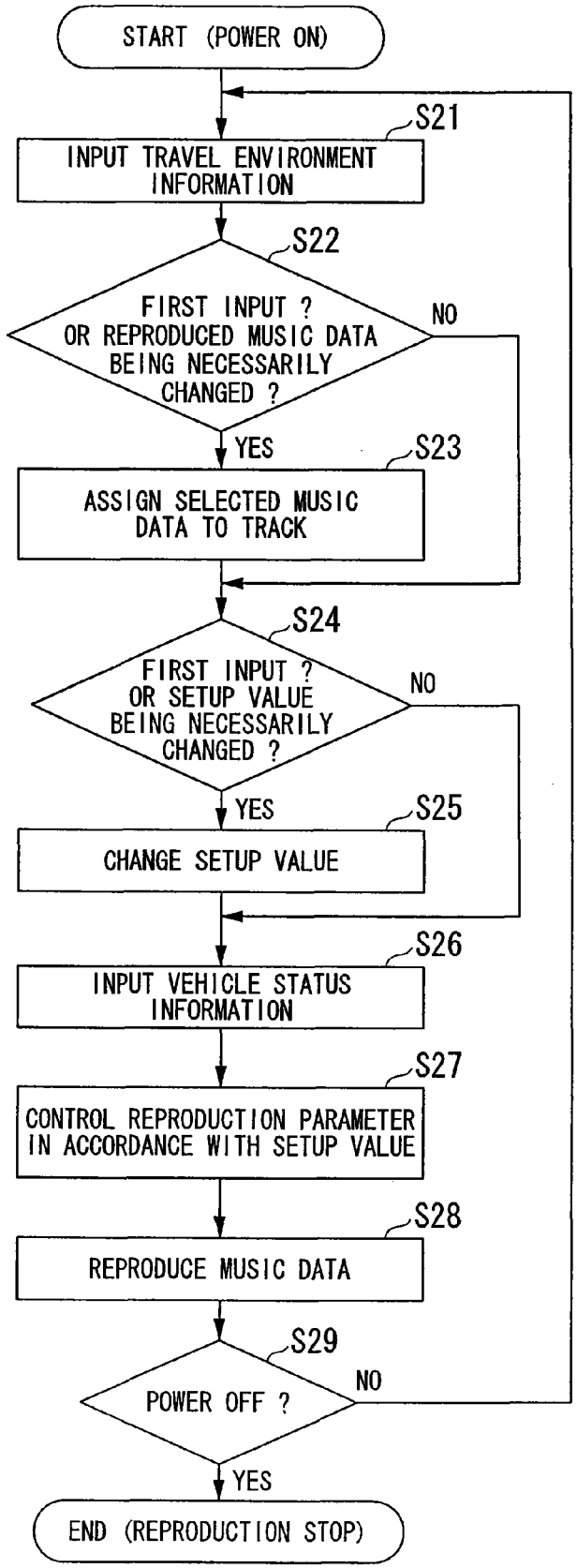
FIG. 14 is a flowchart showing the processing of the music reproduction apparatus according to the second embodiment.

In FIG. 14, when the power switch of the music reproduction apparatus 1 is turned on, the flow proceeds to step S21 in which the travel environment information input section 10 inputs travel environment information. Next, the flow proceeds to step S22 in which a decision is made as to whether or not the input travel environment information is the first one after start-up and in which music data to be reproduced is selected based on the input travel environment information. In addition, the music reproduction apparatus 1 makes a decision as to whether or not the music data to be reproduced differs from the presently reproducing music data, in other words, it makes a decision as to whether or not the music data to be reproduced should be necessarily changed.

In step S22, when it is determined that the input travel environment information matches the travel environment information firstly input after start-up, or when it is determined that the music data to be reproduced differs from the presently reproducing music data, the flow proceeds to step S23 in which the music reproduction apparatus 1 assigns the music data, which is selected based on the input travel environment information, to the track 52. In step S22, when it is determined that the input travel environment information does not match the travel environment information firstly input after start-up, and when it is determined that the music data to be reproduced matches the presently reproducing music data, the music reproduction apparatus 1 skips step S23 so that the flow directly proceeds to step S24.

In step S24, the music reproduction apparatus 1 makes a decision again as to whether or not the input travel environment information matches the travel environment information firstly input after start-up, and it determines the setup values of reproduction parameters based on the input travel environment information. In addition, it makes a decision as to whether or not the setup values of reproduction parameters, which are determined as described above, differ from the setup values presently set to the rhythm pattern control 653, the melody pattern control 654, the tempo control 655, the tone color control 656, the effect control 657, and the volume control 658, in other words, it makes a decision as to whether or not the setup values of the controls 653 to 658 should be necessarily changed.

In step S24, when the music reproduction apparatus 1 determines that the input travel environment information matches the travel environment information firstly input after start-up, or when it determines that the setup values of reproduction parameters being determined as described above differ from the setup values presently set to the controls 653 to 658, the flow proceeds to step S25, in which the setup values presently set to the controls 653 to 658 are changed with the setup values being determined as described above. On the other hand, when the music reproduction apparatus 1 determines that the input travel environment information does not match the travel environment information firstly input after start-up, and when it determines that the setup values of reproduction parameters being determined as described above match the setup values presently set to the controls 653 to 658, the music reproduction apparatus 1 skips step S25 so that the flow directly proceeds to step S26.

In step S26, the music reproduction apparatus 1 inputs vehicle status information by means of the vehicle status information input section 20. In step S27, it determines the setup values based on the vehicle status information so as to control reproduction parameters. In step S28, the music reproduction apparatus 1 reproduces music data by use of reproduction parameters being controlled as described above. Thereafter, until it is determined in step S29 that the power switch is turned off, the music reproduction apparatus 1 repeatedly executes the aforementioned steps S21 to S28.

As described above, the music reproduction apparatus 1 of the second embodiment controls reproduction parameters based on both the vehicle status information and the travel environment information; hence, even when reproduction parameters of the music are varied in response to the vehicle status, it is possible to prevent the reproduced music from becoming unnatural to hear due to travel environments.

The music reproduction apparatus 1 is capable of reproducing music data suited to travel environments.

In this connection, the aforementioned processing can be realized in such a way that programs realizing functions of the music reproduction apparatus 1 of the second embodiment are stored in computer-readable storage media and are loaded into and executed by the computer system.

3. Third Embodiment

Figure 1B:
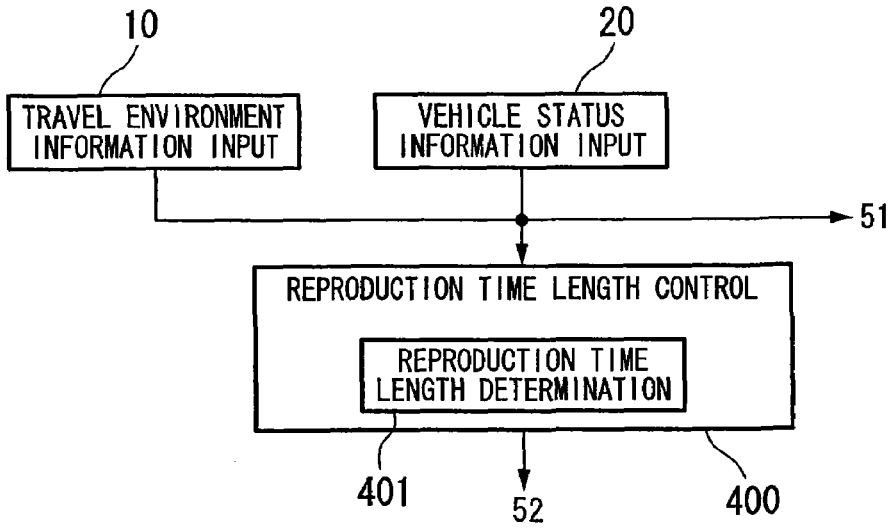
FIG. 1B is a block diagram showing the constitution of a reproduction time length control section installed in the music reproduction apparatus according to the third embodiment of the present invention shown in FIG. 1A.

The basic constitution of the music reproduction apparatus 1 according to the third embodiment of the present invention is identical to that shown in FIG. 1A, wherein it is characterized to further include a reproduction time length control section 400 and a reproduction time length determination section 401 shown in FIG. 1B. The essential elements of the music reproduction apparatus 1 of the third embodiment are the travel environment information input section 10, the vehicle status information input section 20, the reproduction time length control section 400, the tracks 52-1 to **52-*n*, the sound database 70, the reproduction parameter control section 51, and the speaker 81**.

The sound database 70 stores phrases each composed of a single measure. In the following description, one phrase will be defined as the collection of plural musical tones, particularly, base drum sounds, included in one measure.

Figure 15A:
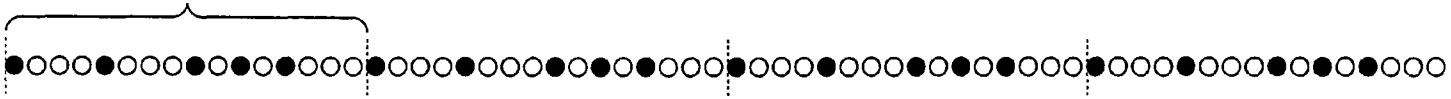
FIG. 15A shows a phrase that the music reproduction apparatus of the third embodiment reproduces with a 100% reproduction time length.

FIG. 15A shows an example of bass drum sound. Herein, one measure is divided into sixteen time lengths or sixteen durations (or intervals), to which sound marks (i.e., black circles) and mute marks (i.e., while circles) are assigned. In addition, sixteen time lengths included in one measure are divided into four units. In time lengths corresponding to sound marks, the tracks 52 reproduce bass drum sounds of predetermined time lengths.

The track 52 repeatedly reproduces the phrase composed of a single music reproduction unit so as to generate a musical tone signal, which is then supplied to the reproduction parameter control section 51. In the third embodiment, the music reproduction unit corresponds to one measure, so that the reproduction time length control section 400 controls reproduction time lengths of the music reproduced by the tracks 52 in music reproduction units. The processing of the reproduction time length control section 400 will be described below.

Next, the music reproduction unit will be described with reference to FIG. 16. Herein, the horizontal axis represents time, in which one block corresponds to one measure. The number written in each block represents the type of musical tones included in the measure. Since the third embodiment is described with respect to the reproduction of the bass drum sound, blocks show sound states and mute states in order, wherein when the phrase designates a melody, each block shows the unit of the melody.

Figure 16:
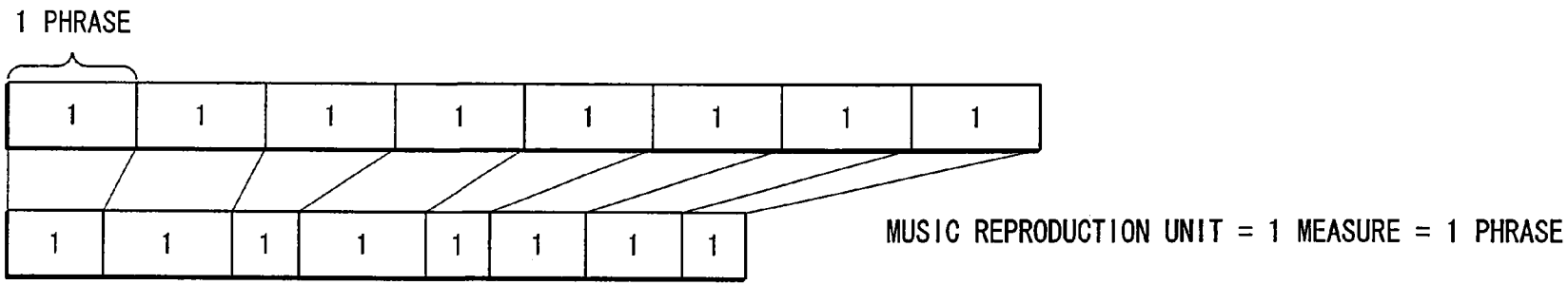
FIG. 16 shows the relationship between the phrase and the music reproduction unit.

As shown in FIG. 16, one phrase corresponds to one measure in the third embodiment; hence, the track 52 repeatedly reproduces one phrase corresponding to one measure, which corresponds to the music reproduction unit.

In this connection, the tracks 52 are each capable of reproducing the same type of the phrase (i.e., the same type of the reproduced music) or different types of phrases. In the third embodiment, musical tone signals reproduced by the plural tracks 52 are synthesized together and are then supplied to the reproduction parameter control section 51.

The reproduction parameter control section 51 controls reproduction parameters (i.e., the volume, pitch, tempo, etc.) applied to musical tone signals reproduced by the tracks 52 in response to the travel environment information and the vehicle status information (which will be collectively referred to as "external condition information"). Musical tone signals whose reproduction parameters are controlled as described above are supplied to the speaker 81. In the third embodiment, the reproduction parameter control section 51 stores reproduction parameters in correspondence with the external condition information in advance; hence, reproduction parameters are read in correspondence with the supplied external condition information, so that musical tone signals being reproduced by the tracks 52 will be controlled based on the read reproduction parameters. Specifically, the reproduction parameter control section 51 stores the volume in correspondence with the velocity, wherein the reproduction parameter representing the volume is read out in correspondence with the supplied external condition information, so that musical tone signals will be controlled in volume. The speaker 81 generates the prescribed music based on musical tone signals inside of a vehicle equipped with the music reproduction apparatus 1.

The external condition information shows external conditions of the music reproduction apparatus 1; specifically, it corresponds to the vehicle status and travel environments. Details of the travel environment information input section 10 connected to the ITS 101 and the GPS 102 and the details of the vehicle status information input section 20 connected to the sensors 201 to 205 have been described in conjunction with the first embodiment; hence, they are not repeated in the third embodiment.

In FIG. 1B, the external condition information is normally supplied to the reproduction time length control section 400 and the reproduction parameter control section 51 with a prescribed time interval. In this case, unless no variation occurs in the external condition, the same external condition information is supplied to the reproduction time length control section 400 and the reproduction parameter control section 51 with the prescribed time interval. Every time variations occur in the external condition, variations in the external condition are supplied to the reproduction time length control section 400 and the reproduction parameter control section 51.

The reproduction time length control section 400 controls reproduction time lengths of music reproduction units (e.g., measures) reproduced by the tracks 52 in response to the external condition information. That is, the reproduction time length control section 400 temporarily stops reproducing the music reproduction unit with the reproduction time length suiting the external condition information, then it compulsorily starts reproducing the next music reproduction unit.

Specifically, the reproduction time length determination section 401 determines the first reproduction start timing or the second or more reproduction start timings based on the reproduction time length suiting the external condition information with respect to the music reproduction unit.

Next, the processing of the reproduction time length determination section 401 will be described with reference to FIG. 17. The reproduction time length determination section 401 stores the relationship between the reproduction time length of one measure and the engine speed shown in FIG. 17 in advance, wherein it determines a prescribed reproduction time length in correspondence with the engine speed suiting the external condition information.

Figure 17:
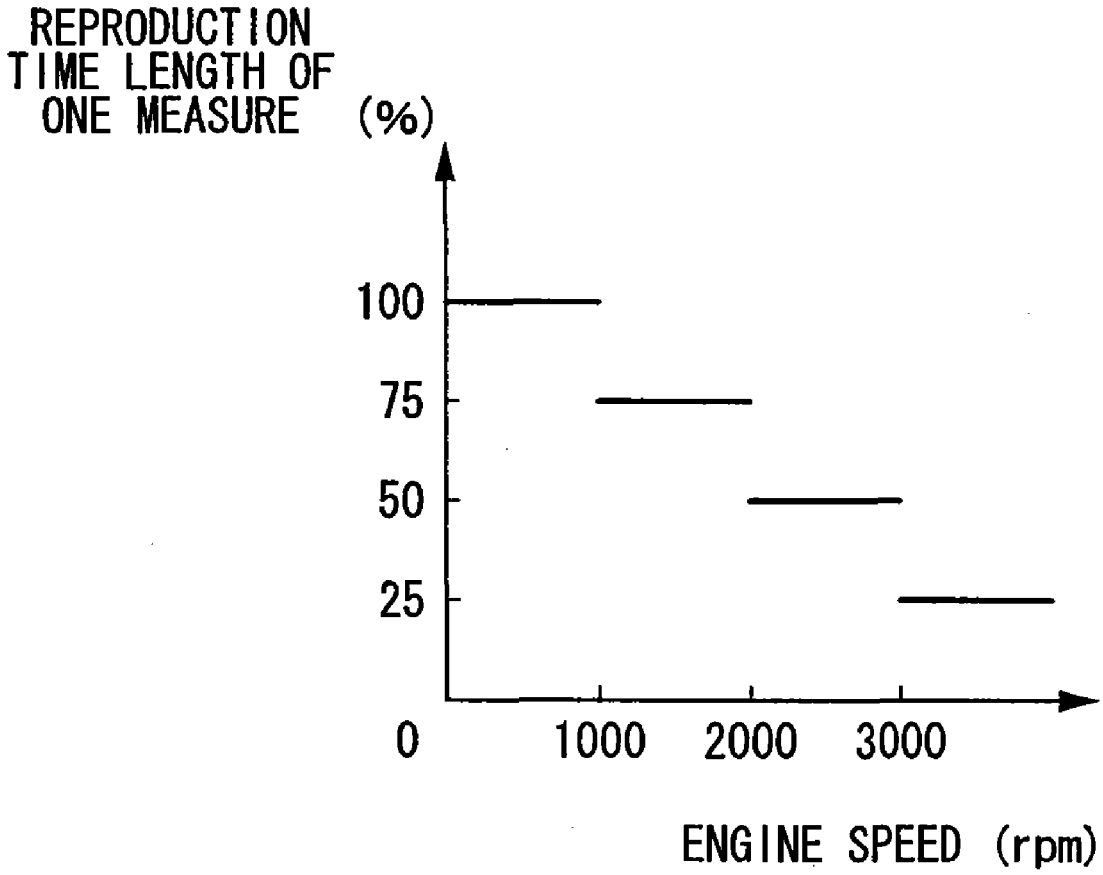
FIG. 17 is a graph showing the relationship between the reproduction time length and the engine speed.

In this connection, it is preferable that the reproduction time length determination section 401 stores not only the relationship between the reproduction time length and the engine speed shown in FIG. 17 but also the relationship between the reproduction time length and various external conditions.

The reproduction time length determination section 401 determines reproduction time lengths independently with respect to the tracks 52; alternatively, it determines the reproduction time length with respect to all the tracks 52 collectively. The reproduction time length control section 400 controls each of reproduction time lengths of music reproduction units being reproduced by the tracks 52 based on the reproduction time length determined by the reproduction time length determination section 401.

FIG. 16 shows phrases whose reproduction time lengths are controlled by the reproduction time length control section 400. That is, upper blocks show phrases that are not controlled in reproduction time lengths and that are reproduced with original reproduction time lengths, while lower blocks show phrases whose reproduction time lengths are controlled (specifically, phrases whose reproduction time lengths are reduced).

The third embodiment sets the music reproduction unit to one measure; hence, the reproduction time length determination section 401 determines the reproduction time length of one measure, which is reproduced at the reproduction start timing (or reproduction restart timing) of each measure by the track 52, in response to the external condition information. The reproduction time length control section 400 controls the reproduction time length of each measure reproduced by the track 52 on the basis of the determined reproduction time length.

Next, concrete examples of reproduction time lengths being controlled will be described with reference to FIGS. 15A to 15D. Herein, the reproduction time length is represented in terms of percentage relative to the original reproduction time length that is defined as 100%.

FIG. 15A show phrases whose reproduction time lengths are not controlled (i.e., reproduction time lengths are each set to 100%), wherein one phrase corresponding to one measure is repeatedly reproduced.

Figure 15B:
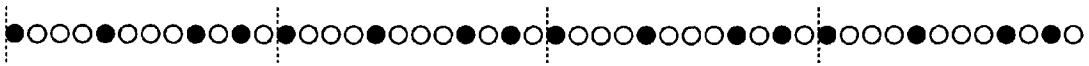
FIG. 15B shows a phrase that the music reproduction apparatus of the third embodiment reproduces with a 75% reproduction time length.

FIG. 15B shows phrases whose reproduction time lengths are reduced to 75%, wherein within sixteen durations included in one measure, only twelve durations corresponding to the first 75% of each measure are repeatedly reproduced.

Figure 15C:
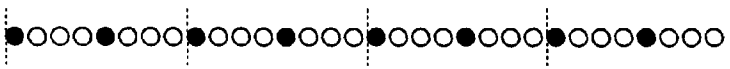
FIG. 15C shows a phrase that the music reproduction apparatus of the third embodiment reproduces with a 50% reproduction time length.

FIG. 15C shows phrases whose reproduction time lengths are reduced to 50%, wherein within sixteen durations included in one measure, only eight durations corresponding to the first 50% of each measure are repeatedly reproduced.

Figure 15D:
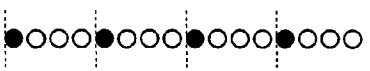
FIG. 15D shows a phrase that the music reproduction apparatus of the third embodiment reproduces with a 25% reproduction time length.

FIG. 15D show phrases whose reproduction time lengths are reduced to 25%, wherein within sixteen durations included in one measure, only four durations corresponding to the first 25% of each measure are repeatedly reproduced.

According to the third embodiment described above, the reproduction time length determination section 401 determines the reproduction time length based on the external condition information, whereby the reproduction time length control section 400 correspondingly controls the reproduction time length with respect to the track 52, in other words, it changes the number of durations included in each measure. That is, when the track 52 repeatedly reproduces one music reproduction unit (corresponding to one measure), it is possible to reproduce the music having rich variations in response to external conditions such as vehicles statuses and travel environments. In particular, it is possible to reproduce the desired music having rich variations by appropriately changing the order of sounds and mutes.

The reproduction time length determination section 401 is capable of determining reproduction time lengths of music reproduction units at the reproduction start timings (or reproduction restart timings) for starting reproduction of music reproduction units by means of the tracks 52.

The third embodiment can be further modified in various ways, which will be described below.

(a) First Variation

The basic constitution of the music reproduction apparatus 1 according to a first variation of the third embodiment is similar to that shown in FIGS. 1A and 1B, wherein a different relationship between one phrase and one measure is featured.

The sound database 70 stores phrases each composed of musical tones included in plural measures (e.g., four measures), wherein the music reproduction unit is set to one measure.

Figure 18:
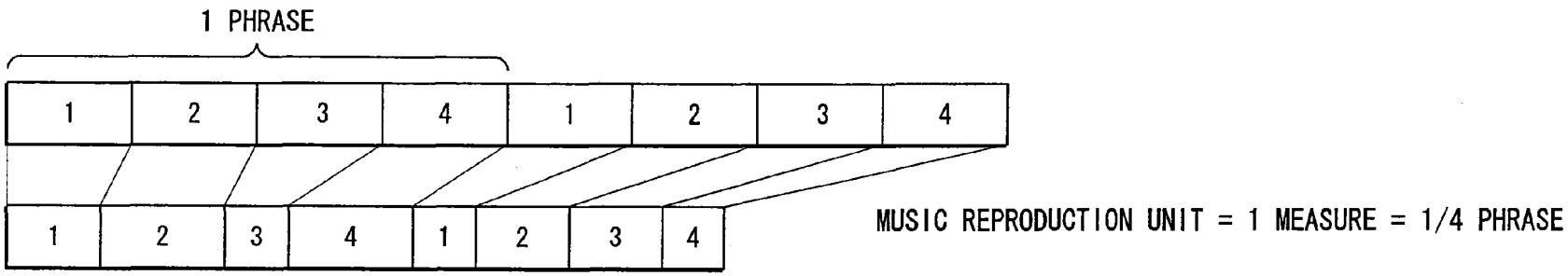
FIG. 18 shows the relationship between the phrase and the music reproduction unit in a first variation of the third embodiment.

FIG. 18 shows the music reproduction unit adapted to the music reproduction apparatus 1 according to the first variation of the third embodiment. Similar to FIG. 16, the horizontal axis direction represents time in FIG. 18, in which one block corresponds to one measure. Numbers written in blocks indicate types of the music (e.g., the order of sounds and mutes of bass drum sounds, melodies, etc.) expressed by measures thereof.

As shown in FIG. 18, in the first variation, four measures correspond to one phrase being repeatedly reproduced, whereas the track 52 uses one measure as the music reproduction unit so as to repeatedly reproduce the phrase composed of four measures.

The reproduction time length control section 400 controls reproduction time lengths of music reproduction units (i.e., measures) with respect to phrases being reproduced by the tracks 52 in response to the external condition information representing the vehicle status and travel environments.

Specifically, the reproduction time length determination section 401 determines reproduction time lengths at the reproduction start timings (or reproduction restart timings) for starting reproduction of music reproduction units in response to the external condition information. The reproduction time length control section 400 controls reproduction time lengths of music reproduction units being reproduced by the tracks 52 on the basis of reproduction time lengths determined by the reproduction time length determination section 401.

FIG. 18 shows an example of the reproduction time length being controlled, wherein, similar to FIG. 16, upper blocks indicate phrases whose reproduction time lengths are not controlled, while lower blocks indicate phrases whose reproduction time lengths are controlled.

Since the first variation sets the music reproduction unit to one measure, the reproduction time length determination section 401 determines the reproduction time length of each measure in response to the external condition information at the reproduction start timing (or reproduction restart timing) for starting reproduction of one measure by means of the track 52. The reproduction time length control section 400 controls reproduction time lengths of measures being reproduced by the tracks 52 on the basis of the reproduction time length determined by the reproduction time length determination section 401. Lower blocks of FIG. 18 show an example of the result of the controlled reproduction time lengths.

In the first variation described above, when the track 52 repeatedly reproduces a phrase composed of plural music reproduction units (i.e., plural measures), it is possible to reproduce the music having rich variations in response to the external condition information such as vehicle statuses and travel environments.

(b) Second Variation

A second variation uses the music reproduction apparatus 1 shown in FIGS. 1A and 1B, wherein a different relationship between the phrase and measure is featured.

The sound database 70 stores phrases each composed of musical tones included in plural measures (e.g., four measures). The first variation sets the music reproduction unit to one measure, whereas the second variation sets the music reproduction unit to the number of measures (e.g., two measures) that is smaller than the number of measures forming one phrase.

Figure 19:
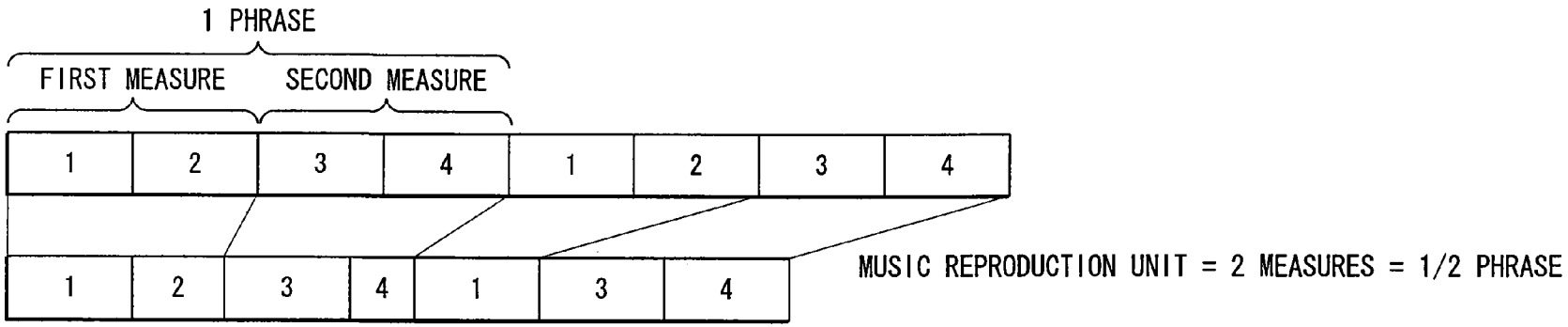
FIG. 19 shows the relationship between the phrase and the music reproduction unit in a second variation of the third embodiment.

FIG. 19 shows the relationship between the phrase and music reproduction unit in the second variation. Similar to FIG. 16 and FIG. 18, the horizontal axis direction represents time in FIG. 19, in which each block corresponds to one measure. Numbers written in blocks indicate types of the music (e.g., the order of sounds and mutes of bass drum sounds, melodies, etc.) expressed in measures.

As shown in FIG. 19, the second variation is designed such that the track 52 repeatedly reproduces one phrase composed of four measures, in which two measures are set to the music reproduction unit, the reproduction time length of which is being controlled.

The reproduction time length control section 400 controls the reproduction time length of the music reproduction unit composed of two measures in response to the external condition information.

Specifically, the reproduction time length determination section 401 determines reproduction time lengths at the reproduction start timings (or reproduction restart timings) for starting reproduction of music reproduction units in response to the external condition information such as vehicle statuses and travel environments. The reproduction time length control section 400 controls reproduction time lengths of music reproduction units being reproduced by the tracks 52 on the basis of the reproduction time length determined by the reproduction time length determination section 401.

FIG. 19 shows an example of the reproduction time length being controlled by the reproduction time length control section 400. Similar to FIG. 16 and FIG. 18, upper blocks indicate the result in which the reproduction time length is not controlled, and lower blocks indicate the result in which the reproduction time length is controlled.

Since the second variation sets the music reproduction unit to two measures, the reproduction time length determination section 401 determines reproduction time lengths of music reproduction units at the reproduction start timings (or reproduction restart timings) for starting reproduction of music reproduction units by means of the tracks 52 in response to the external condition information. The reproduction time length control section 400 controls reproduction time lengths of music reproduction units each composed of two measures in the tracks 52 on the basis of the reproduction time length determined by the reproduction time length determination section 401. Lower blocks of FIG. 19 indicate the result of the controlled reproduction time length. Specifically, when the reproduction time length of the music reproduction unit composed of two measures is reduced, it may be possible to reduce both the first measure and the second measure; actually, however, only the second measure is reduced.

In the second variation described above, when the track 52 repeatedly reproduces one phrase composed of four measures, the reproduction time length of the music reproduction unit composed of two measures is controlled in response to the external condition information, thus realizing reproduction of the music having rich variations.

(c) Third Variation

A third variation uses the music reproduction apparatus 1 shown in FIGS. 1A and 1B, wherein a different relationship between the phrase and music reproduction unit is featured.

The sound database 70 stores phrases each composed of musical tones included in plural measures (e.g., four measures), wherein the music reproduction unit is set to four measures (i.e., one phrase).

Figure 20:
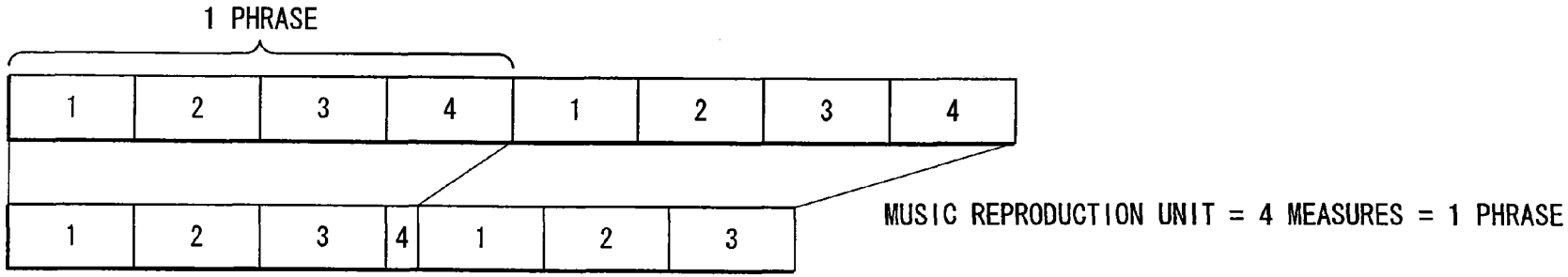
FIG. 20 shows the relationship between the phrase and the music reproduction unit in a third variation of the third embodiment.

FIG. 20 shows the relationship between the phrase and music reproduction unit in the third variation. Similar to FIGS. 16, 18, and 19, the horizontal axis direction represents time in FIG. 20, in which each block corresponds to one measure. Numbers written in blocks indicate types of the music (e.g., the order of sounds and mutes bass drum sounds, melodies, etc.) expressed by measures.

As shown in FIG. 20, the third variation sets the music reproduction unit reproduced by the track 52 to one phrase composed of four measures.

The reproduction time length control section 400 controls reproduction time lengths of music reproduction units (i.e., phrases each composed of four measures) reproduced by the tracks 52 in response to the external condition information.

Specifically, the reproduction time length determination section 401 determines reproduction time lengths at the reproduction start timings (or reproduction restart timings) of music reproduction units being reproduced by the tracks 52 in response to the external condition information. The reproduction time length control section 400 controls each of reproduction time lengths of music reproduction units being reproduced by the tracks 52 on the basis of the reproduction time length determined by the reproduction time length determination section 401.

FIG. 20 shows the result of reproduction time lengths controlled by the reproduction time length control section 400. Similar to FIGS. 16, 18, and 19, upper blocks indicate the result in which reproduction time lengths are not controlled, and lower blocks indicate the result in which reproduction time lengths are controlled.

The third variation sets the music reproduction unit to one phrase composed of four measures; hence, the reproduction time length determination section 401 determines reproduction time lengths of music reproduction units in response to the external condition information at the reproduction start timings (or reproduction restart timings) for starting reproduction by means of the tracks 52. The reproduction time length control section 400 controls each of reproduction time lengths of music reproduction units reproduced by the tracks 52 on the basis of the reproduction time length determined by the reproduction time length determination section 401. Lower blocks indicate the result of controlled reproduction time lengths in FIG. 20.

In the third variation described above, when the tracks 52 repeatedly reproduce music reproduction units each corresponding to one phrase composed of four measures, reproduction time lengths of music reproduction units are controlled in response to the external condition information; hence, it is possible to reproduce the music having rich variations.

(d) Fourth Variation

Figure 1C:
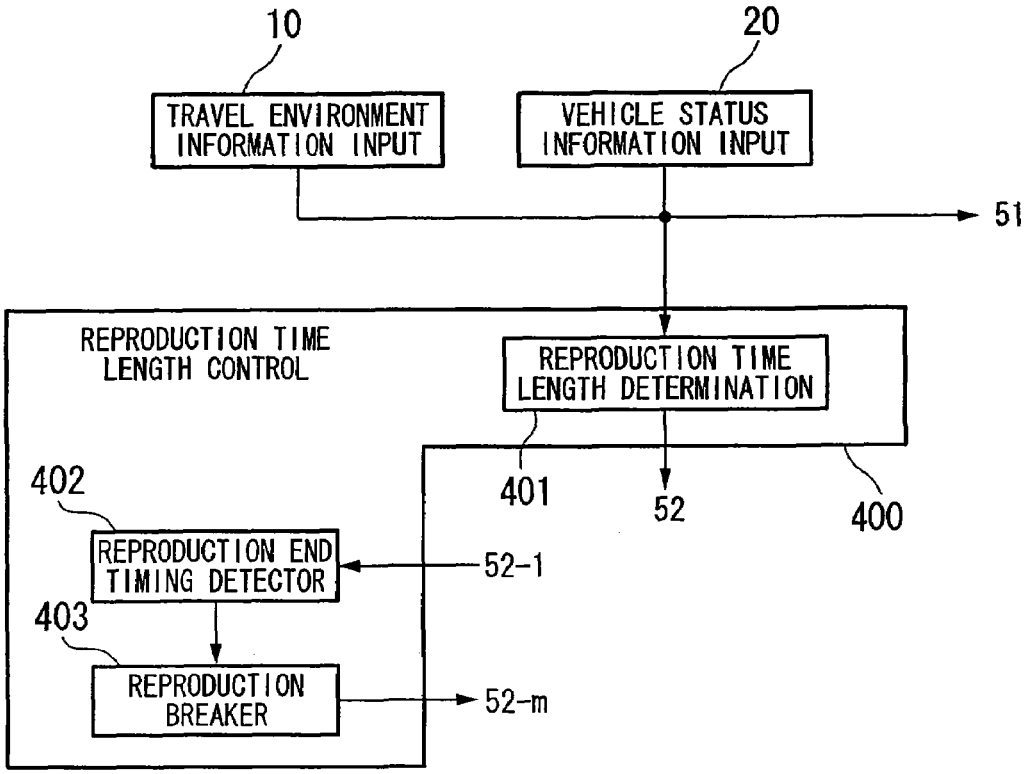
FIG. 1C is a block diagram showing the internal constitution of the reproduction time length control section according to a variation of the third embodiment of the present invention.

The music reproduction apparatus 1 according to a fourth variation further includes the reproduction time length control section 400 having the constitution shown in FIG. 1C in addition to the basic constitution shown in FIG. 1A. In FIG. 1C, the reproduction time length control section 400 includes a reproduction end timing detector 402 and a reproduction breaker 403 in addition to the reproduction time length determination section 401.

In the fourth variation, one phrase is composed of one measure (see FIG. 16), wherein the plural tracks 52 are divided into two groups. That is, the track 52-1 sets the music reproduction unit to one measure, while each of the other tracks 52-*m* (where m is an integer that is "2" or higher) sets the music reproduction unit to the first, second, and fourth measures included in four measures forming one phrase as shown in FIGS. 18, 19, and 20.

The reproduction time length control section 400 controls the reproduction time length of the music reproduction unit (i.e., one measure) reproduced by the track 52-1 in response to the external condition information.

Specifically, the reproduction time length determination section 401 determines the reproduction time length in response to the external condition information at the reproduction start timing (or reproduction restart timing) of the music reproduction unit reproduce by the track 52-1. The reproduction time length control section 400 controls the reproduction time length of the music reproduction unit reproduced by the track 52-1 on the basis of the reproduction time length determined by the reproduction time length determination section 401. Thus, it is possible to realize the result indicated by lower blocks in FIG. 16.

When the reproduction end timing detector 402 detects the reproduction end timing of the music reproduction unit reproduced by the track 52-1, the reproduction time length control section 400 controls the reproduction start timings (or reproduction restart timings) with respect to music reproduction units reproduced by the other tracks 52-*m*.

Figure 21:
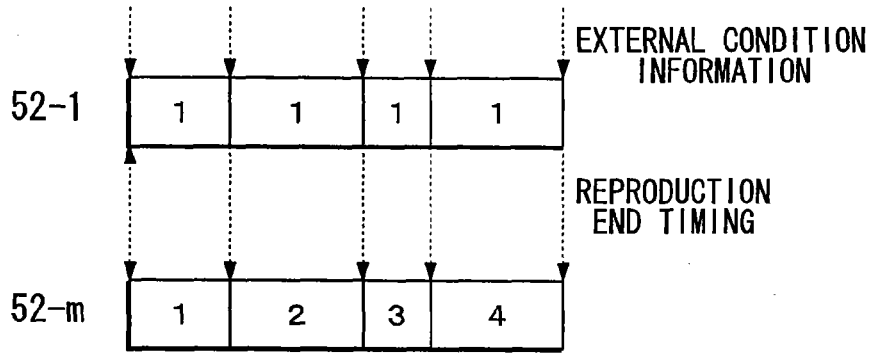
FIG. 21 shows the relationship between the phrase and music reproduction unit (i.e., one measure) reproduced by other tracks in a fourth variation of the third embodiment.

FIG. 21 shows the processing (see FIG. 18) in which the other tracks 52-*m* repeatedly reproduce phrases each composed of four measures in relation to music reproduction units each corresponding to one measure. That is, both the track 52-1 and the other tracks 52-*m* each set the music reproduction unit to one measure; therefore, one measure is reproduced with the same reproduction time length when the reproduction time length control section 400 does not control the reproduction time length.

When the reproduction time length control section 400 controls the reproduction time length in response to the external condition information, it is possible to determine the reproduction end timing with respect to the music reproduction unit reproduced by the track 52-1. The reproduction end timing detector 402 detects the reproduction end timing of the track 52-1 so as to output it to the reproduction breaker 403. That is, the reproduction end timing detector 402 detects the reproduction end timing of the track 52-1 for each measure, wherein the reproduction end timing can be detected by way of the track 52-1, alternatively, it can be detected based on the reproduction time length determined by the reproduction time length determination section 401.

The reproduction breaker 402 breaks the reproduction of music reproduction units (each corresponding to one measure) presently reproduced in the other tracks 52-*m* at the reproduction end timing of the track 52-1. Thereafter, the reproduction time length control section 400 controls the tracks 52 to start or restart the reproduction of the next music reproduction unit.

Figure 22:
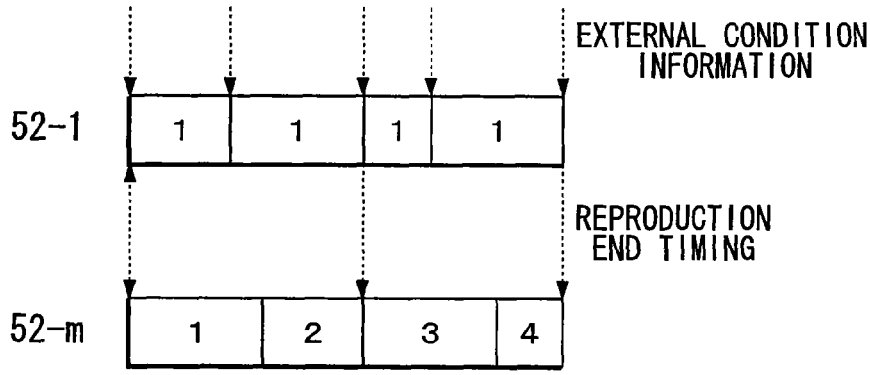
FIG. 22 shows the relationship between the phrase and music reproduction unit (i.e., two measures) reproduced by other tracks in the fourth variation of the third embodiment.

FIG. 22 shows the processing (see FIG. 19) in which the other tracks 52-*m* repeatedly reproduce phrases each composed of four measures in music reproduction units each composed of two measures.

The reproduction end timing detector 402 detects the reproduction end timings of music reproduction units (each corresponding to two measures) reproduced by the other tracks 52-*m* with respect to phrases each composed of four measures. The reproduction breaker 403 breaks the reproduction of music reproduction units presently reproduced by the other tracks 52-*m* at the detected reproduction end timing. Thereafter, the reproduction time length control section 400 controls the tracks 52 to start or restart the reproduction of the next music reproduction unit.

Figure 23:
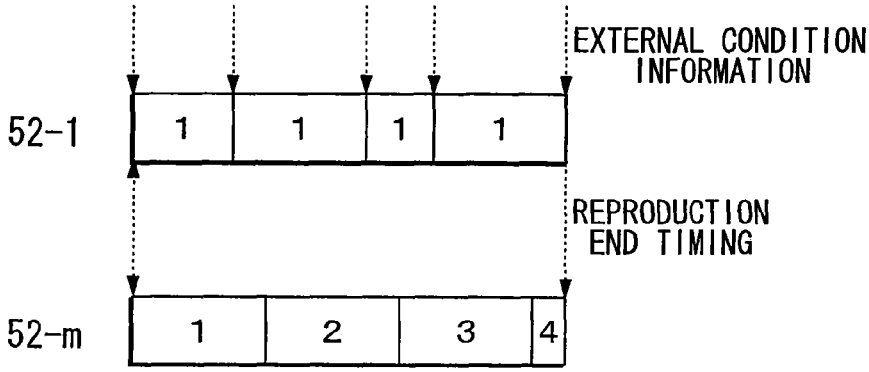
FIG. 23 shows the relationship between the phrase and music reproduction unit (i.e., four measures) reproduced by other tracks in the fourth variation of the third embodiment.

FIG. 23 shows the processing (see FIG. 20) in which the other tracks 52-*m* repeatedly reproduce phrases each composed of four measures in music reproduction units each composed of four measures.

The reproduction end timing detector 402 detects the reproduction end timings of music reproduction units (each composed of four measures) reproduced by the other tracks 52-*m* with respect to phrases each composed of four measures. The reproduction breaker 403 breaks the reproduction of music reproduction units (each composed of four measures, i.e., one phrase) presently reproduced by the other tracks 52-*m* at the detected reproduction end timing. Thereafter, the reproduction time length control section 400 controls the tracks 52 to start or restart the reproduction of the next music reproduction unit.

According to the fourth variation described above, it is possible to synchronize the reproduction start timing of the music reproduction unit (i.e., one measure) reproduced by the track 52-1 with the reproduction start timings of the music reproduction units (each composed of four measures) reproduced by the other tracks 52-*m*. In this connection, the music reproduction unit reproduced by the track 52-1 is not necessarily limited to one measure; hence, it can be set to two or more measures.

The third embodiment of the present invention can be further modified in various manners other than the first to fourth variations.

The third embodiment and its variations are all designed to be adapted to the music reproduction apparatus 1, which is not necessarily limited to a music reproduction apparatus installed in a vehicle; hence, they can be adapted to any type of music reproduction apparatuses. For example, the third embodiment can be adapted to a portable audio player. In this case, the external condition information can be produced in response to the number of user's steps counted by a pedometer or in response to the number of revolutions of wheels of a wheelchair.

FIGS. 15A, 15B, 15C, and 15D show examples of reproduction time lengths, which are set to 100%, 75%, 50%, and 25%. These values may be effective for the 4-beat music; hence, in order to reproduce the music having another number of beats such as eight beats and sixteen beats, it is necessary to reduce the reproduction time length with a ratio suiting the number of beats.

In the third embodiment and its variations, the music reproduction unit is set to one measure, two measures, and four measures. Of course, the music reproduction unit is not necessarily limited to the aforementioned numbers of measures; hence, it can be arbitrarily set to various time lengths. One phrase is not necessarily composed of one measure or four measures; hence, one phrase can be composed of two measures, eight measures, sixteen measures, and thirty-two measures, for example.

It is possible for the user to adopt any one of the third embodiment and its variations. That is, it is possible to design the music reproduction apparatus 1 to suite any types of examples and to install programs operable in any types of examples in response to user's input instructions.

4. Fourth Embodiment

Next, a music information distribution system according to a fourth embodiment of the present invention will be described in detail.

Figure 1D:
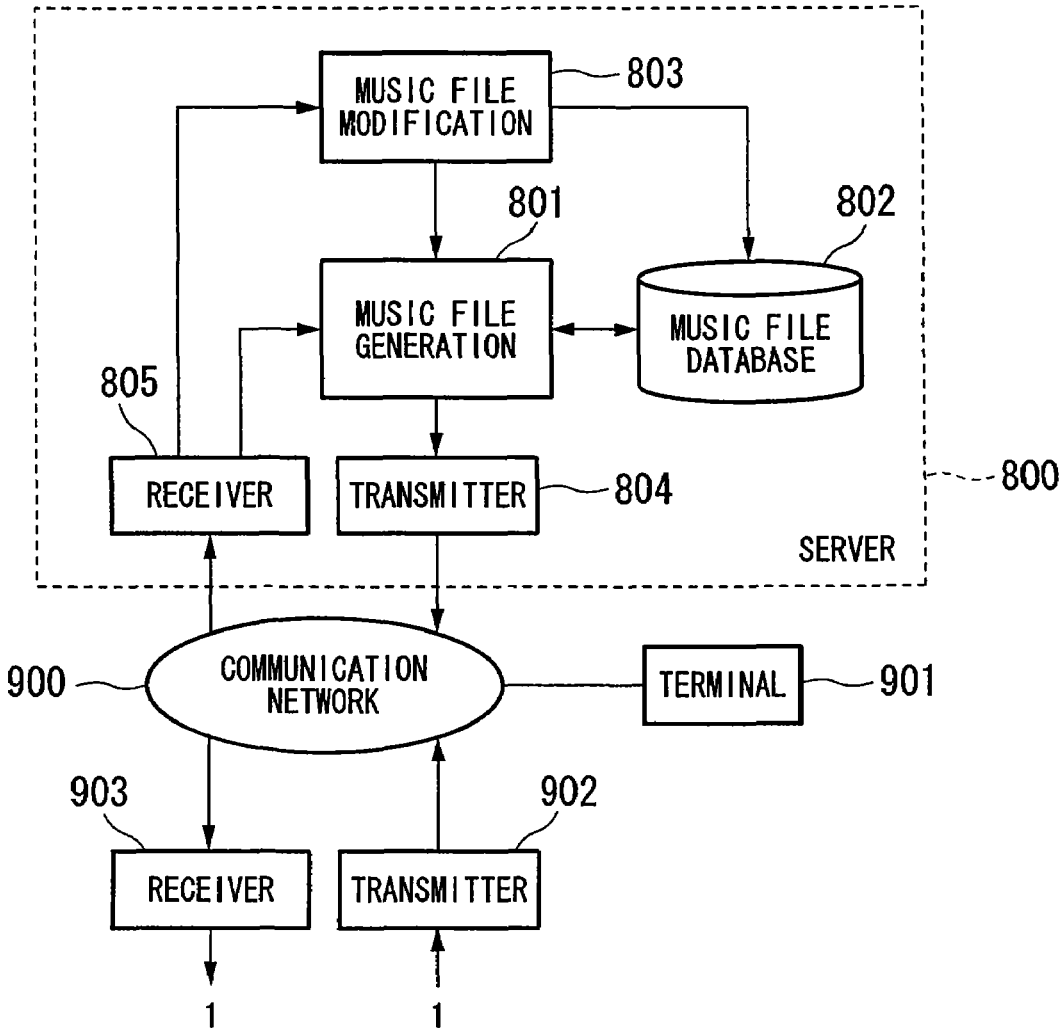
FIG. 1D is a block diagram showing the constitution of a server, which is installed in a music information distribution system according to the fourth embodiment of the present invention and which is connected to the music reproduction apparatus shown in FIG. 1A via a communication network.

FIG. 1D is a block diagram showing the constitution of the music information distribution system, in which the music reproduction apparatus 1 whose basic constitution is shown in FIG. 1D is connected to a server 800 via a communication network 900. In addition, a terminal 901 is connected to the server 800 via the communication network 900 so as to edit music information (i.e., music data) accumulated in the server 800.

The server 800 includes a music file generation section 801, a music file database 802, a music file modification section 803, a transmitter 804, and a receiver 805. The music file generation section 801 generates music files to be distributed to the music reproduction apparatus 1. Herein, music files are music data accompanied with reproduction parameters. The music file database 802 stores a plurality of music files in advance. The music file modification section 803 changes and modifies configurations of music files based on the reproduction record of music files in the music reproduction apparatus 1. The transmitter 804 transmits music information, which is distributed by the server 800, to the music reproduction apparatus 1 and the terminal 901 via the communication network 900. The receiver 805 receives information from the music reproduction apparatus 1 and the terminal 901. The server 800 is connectible to a plurality of information terminals (i.e., the music reproduction apparatus 1 and the terminal 901 in the fourth embodiment) via the communication network 900, which thus transmit and receive information therebetween.

A vehicle is equipped with a transmitter 902 and a receiver 903, which are connected to the communication network 900 and via which a communication link is established in the music reproduction apparatus 1 with the server 800. The constitution of the music reproduction apparatus 1 of the fourth embodiment is shown in FIG. 1A; specifically, it includes the travel environment information input section 10 connected to the ITS 101 and the GPS 102, the vehicle status information input section 20 connected to various sensors, the tone generation control section 50 having a plurality of tracks 52, the sound selection control section 60, the sound database (which serves as a music file storage in the fourth embodiment), the audio signal synthesizing section 80, and the speaker 81. In the fourth embodiment, the music file storage 70 is capable of storing a plurality of music files received from the server 800, so that the sound selection control section 60 selects a desired music file from among music files so as to supply it to the track 52 included in the tone generation control section 50.

Figure 25:
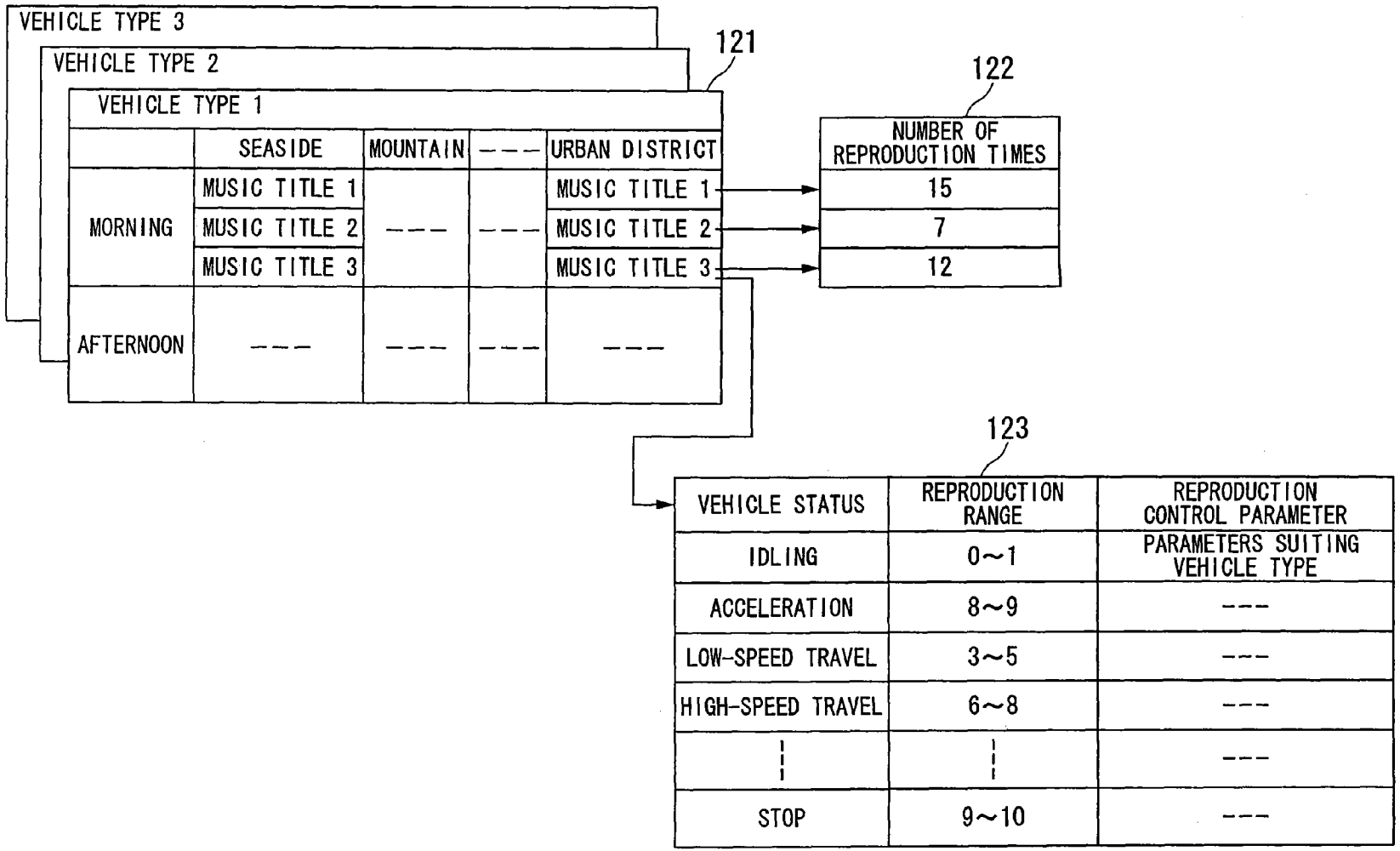
FIG. 25 shows the structure of a music file database included in the server.

Next, the structure of the music file database 802 shown in FIG. 1D (i.e., the software architecture composed of plural tables) will be described with reference to FIG. 25.

The music file database 802 is constituted of a distributed data table 121 for defining distributed music data, a reproduction record table 122 for defining the reproduction record (i.e., the number of reproduction times) with respect to distributed music data, and a reproduction parameter table 123 for defining reproduction parameters controlling reproduction methods with respect to distributed music data.

The distributed data table 121 defines a plurality of titles of music data to be reproduced in response to the time (e.g., morning or afternoon) and the travel environment information (e.g., seaside areas, mountains, etc.) with respect to types of vehicles (e.g., types and names of vehicles such as sedan cars and 1-box cars). For example, when a vehicle type 1 runs in an urban district in the morning, music titles 1 to 3 are defined with respect to music data to be reproduced.

The reproduction record table 122 stores reproduction records (i.e., number of reproduction times) in vehicle types with respect to music titles of music data to be reproduced in response to the time and travel environments. FIG. 25 shows reproduction records (i.e., "15", "7", and "12" in reproduction times) with respect to music titles 1, 2, and 3, which are listed in certain conditions, i.e., vehicle type 1, morning, and urban district. Actually, reproduction records are produced with respect to all vehicle types suited to prescribed conditions defined in the distributed data table 121 and are stored in the reproduction record table 122.

The reproduction parameter table 123 defines the relationship between reproduction ranges (which are defined between reproduction start points and reproduction end points) dependent upon vehicle statuses and reproduction parameters (e.g., volumes, pitches, tempos, etc.) with respect to music titles of music data to be reproduced in response to times and travel environments. For example, the reproduction parameter table 123 defines the relationship between reproduction ranges and reproduction parameters suiting travel environments in correspondence with vehicle statuses (e.g., idling, etc.) with respect to music title 3 that is distributed when vehicle type 1 runs in an urban district in the morning. FIG. 25 shows only the reproduction parameter table 123 with respect to music title 3 that is distributed when vehicle type 1 runs in an urban district in the morning. Actually, the reproduction parameter table 123 is provided with respect to all music titles defined in the distributed data table 121.

Figure 24:
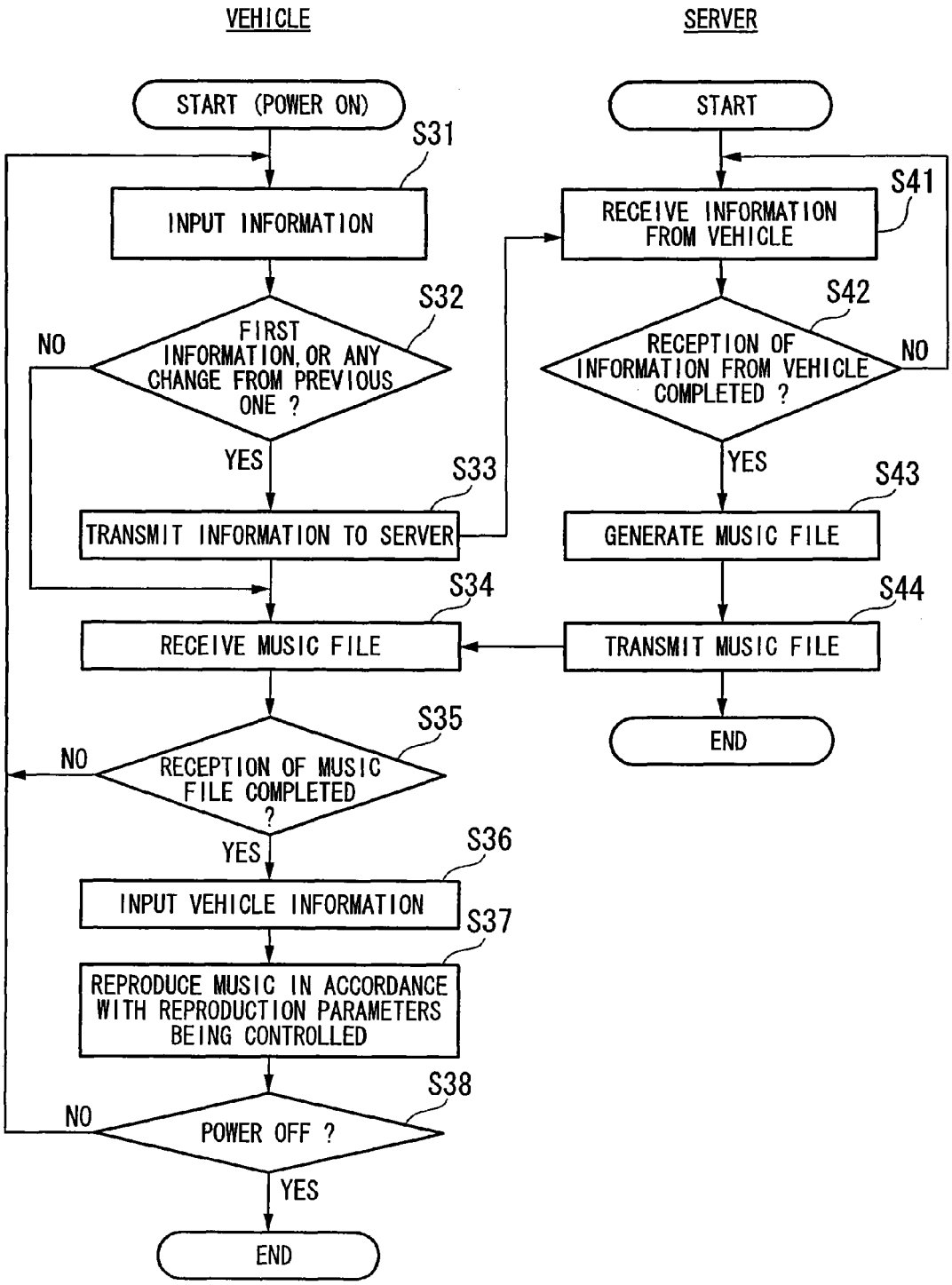
FIG. 24 is a flowchart showing the processing regarding the music reproduction apparatus and the server in the music information distribution system according to the fourth embodiment of the present invention.

Next, the processing of the server 800 shown in FIG. 1D and the processing of the music reproduction apparatus 1 will be described with reference to FIG. 24. When the power switch of the music reproduction apparatus 1 is turned on, the flow proceeds to step S31 in which the vehicle status information input section 10 inputs vehicle status information (i.e., vehicle type, time, traveling position, etc.). Next, the flow proceeds to step S32 in which a decision is made as to whether or not the input vehicle status information is the first one after power-on and in which a decision is made as to whether or not the presently input vehicle status information differs from the previous vehicle status information. When it is determined that the input vehicle status information is the first one after power-on and that the presently input vehicle status information differs from the previous vehicle status information, the flow proceeds to step S33 in which the input vehicle status information is transmitted to the server 800 at a prescribed address by means of the transmitter 902 connected to the communication network 900. The vehicle status information includes a vehicle identifier (i.e., an address of the server 800) for identifying a vehicle. Thereafter, the vehicle is placed in a standby state.

In step S41, the music file generation section 801 of the server 800 receives the vehicle status information transmitted thereto from the music reproduction apparatus 1 via the receiver 805. In step S42, a decision is made as to whether or not the reception of the vehicle status information is completed. When a decision result of step S42 is "YES", the flow proceeds to step S43 in which the music file generation section 801 retrieves music titles of music data to be reproduced with reference to the music file database 802. For example, when the vehicle status information transmitted from the music reproduction apparatus 1 indicates the condition, in which vehicle type 1 runs in an urban district in the morning, the music file generation section 801 inputs music titles 1 to 3 as shown in FIG. 25 so as to specify three music data, which are then read from the music file database 802. Thereafter, the music file generation section 801 reads the reproduction parameter table 123 related to three music titles 1 to 3 from the music file database 802.

Next, the flow proceeds to step S43 in which the music file generation section 801 establish the relationship between three music data, which are read from the music file database 802, and the reproduction parameter table 123, thus generating three music files. The number of music files generated by the music file generation section 801 corresponds to the number of music titles defined in the distributed data table 121. Subsequently, in step S44, the music file generation section 801 transmits three music files to the music reproduction apparatus 1 installed in the vehicle, which is specified by the vehicle identifier included in the inputted vehicle status information.

That is, in step S34, music files transmitted from the server 800 are received by the music reproduction apparatus 1 via the receiver 903. When no music file is transmitted from the server 800 or the reproduction of a music file is not possible, the music reproduction apparatus 1 repeats the step S31. When plural music files are distributed, the driver of a vehicle (or a companion sharing the same vehicle) operates the music reproduction apparatus 1 so as to select a desired music file to be reproduced by way of the sound selection control section 60. After confirmation of the completion of the reception of the music file in step S35, the flow proceeds to step S36 in which the tone generation control section 50 inputs the vehicle status information representing the present vehicle status from the vehicle status information input section 20 with respect to the specified music file. Then, the tone generation control section 50 reads the specified music file from the music file storage 70 so as to save the corresponding music data together with the reproduction parameter table 123 that is attached to but independently of the music data.

Next, the tone generation control section 50 detects a reproduction range (defined by the reproduction start timing and the reproduction end timing) of the music data suiting the vehicle status information input by the vehicle status information input section 20 with reference to the reproduction parameter table 123, so that the music data of the reproduction range is output to the reproduction section (which corresponds to the tracks 52 and the audio signal synthesizing section 80 in FIG. 1A). At this time, the tone generation control section 50 reads reproduction parameters suiting the vehicle status information and the reproduction range from the reproduction parameter table 123 so as to output them to the reproduction section. The audio signal synthesizing section 80 controls musical tones, which are generated by the speaker 81 based on reproduction parameters (e.g., volumes, equalizer adjustments, etc.) controlled by the reproduction parameter control section 51, thus reproducing music data in step S37.

As described above, an appropriate musical tune is selected in response to the vehicle type, time, and travel environments, so that reproduction control is performed in response to the present vehicle status so as to reproduce a desired musical tune. The aforementioned processing is repeatedly executed until the power switch of the music reproduction apparatus 1 is turned off.

While the audio signal synthesizing section 80 is reproducing music data, the music title and the number of reproduction times (i.e., the reproduction record) are transmitted to the server 800. In the server 800, the music file modification section 803 stores the received reproduction record in the reproduction record table 122 of the music file database 802. In FIG. 25, the reproduction record table 122 accumulates the reproduction record regarding the vehicle type 1. The music file modification section 803 instructs the music file generation section 801 to select music titles to be distributed with reference to the reproduction record table 122. In step S43 shown in FIG. 24, the music file generation section 801 prioritizes the selection of the music title whose number of reproduction times is the largest with reference to the reproduction record table 122. Thus, in the initial stage, it is unnecessary to notify the music reproduction apparatus 1 of plural music titles, wherein only the music title having the larger number of reproduction times is selectively notified to the music reproduction apparatus; hence, it is possible to select an appropriate musical tune. When the reproduction record table 122 is arranged in each vehicle type, it is possible for the music reproduction apparatus 1 installed in each vehicle type to communicate the server 800 to use only the reproduction record suiting each vehicle type.

When music data are reproduced with reproduction parameters controlled by the reproduction parameter control section 51 by means of the tracks 52 included in the reproduction section, it is possible for the reproduction record to include the user setup information, which represents that the driver of a vehicle (or a companion sharing the same vehicle) operates the music reproduction apparatus 1 to adjust the volume or equalizer, or the travel environment information input by the travel environment information input section 10. It is possible for the music file modification section 803 to update reproduction parameters stored in the reproduction parameter table 123 based on the user setup information or to rewrite the content of the distributed data table 121 or the content of the reproduction parameter table 123 based on the travel environment information. As described above, since music files stored in the music file database 802 are modified or updated in response to the reproduction record representing the music reproduction status in the music reproduction apparatus 1 to which the server 800 distributes music files, it is possible for the server 800 to provide the music reproduction apparatus 1 installed in the vehicle with an optimum musical tune suiting the vehicle status.

In addition, it is possible to transmit music files stored in the music file database 802 to the terminal 901, in which they are appropriately modified or corrected and are then uploaded to the server 800. This makes it possible to adjust music files distributed from the server 800 to suit the user's preference; hence, it is possible to download optimum music data to the music reproduction apparatus 1.

Incidentally, the vehicle status information, which is transmitted from the music reproduction apparatus 1 to the server 800, can include the serial number and type of a vehicle, the specification of an audio system (i.e., two-channel stereo, 4-channel stereo, hi-fi audio, equalizer type, changeable range of reproduction parameters, etc.), the individual information of the driver of a vehicle, companion's information, and driving objectives (i.e., commuting, job, leisure, travel, etc.); hence, it is possible for the distributed data table 121 to store music titles to be distributed in correspondence with the aforementioned pieces of the vehicle status information.

In the fourth embodiment described above, the server 800 stores music data, vehicle status information, and reproduction parameters in correspondence with travel environment information, wherein it selects an optimum music title in response to the travel environment information and vehicle status information transmitted from the music reproduction apparatus 1 installed in a vehicle; it reads reproduction parameters related to the music data, so that it generates and transmits a music file combining the music data and reproduction parameters to the music reproduction apparatus 1. Thus, the music reproduction apparatus 1 reproduces the selected music data in response to travel environments of a vehicle so as to perform reproduction control thereof in response to the vehicle status; hence, it is possible to appropriately vary the reproduction manner of a musical tune in response to variations in the travel position and travel environments of a vehicle. In addition, since the server 800 distributes music data to the music reproduction apparatus 1, it is not necessary for the music reproduction apparatus 1 to prepare music data in advance; hence, it is possible to autonomously reproduce the music in response to the vehicle status.

As described above, the driver or companion of a vehicle can enjoy the music, which is varied in response to travel environments, without loosing interest; hence, it is possible to create unique music reproduction environments. Since the reproduced music varies in response to travel environments, the driver or companion of a vehicle can recognize travel environments sensationally.

The fourth embodiment is described in such a way that music files are transmitted to the music reproduction apparatus 1 installed in a vehicle, wherein the vehicle is not necessarily limited to a four-wheeled automobile but can be interpreted as a two-wheeled motorcycle. In addition, the fourth embodiment is applicable to a car navigation system accompanied with a travel route guidance function or a portable information terminal. That is, the fourth embodiment is applicable to all mobile devices (e.g., notebook computers, cellular phones, portable information terminals, etc.) having functions for transmitting specifications of music playback devices and position information to servers.

Lastly, the present invention is not necessarily limited to the first to fourth embodiments, which can be appropriately modified within the scope of the invention as defined in the appended claims.

What is claimed is:

1. A music reproduction apparatus comprising:

a vehicle status information input section for inputting vehicle status information representing a vehicle status;

a reproduction section for assigning a plurality of phrases whose types differ from each other to a plurality of tracks to reproduce the phrases in terms of at least one reproduction parameter being controlled with respect to each of the tracks;

a control section for controlling the reproduction parameter in response to the vehicle status information with respect to each of the tracks; and a setup value storage for storing a setup value of the reproduction parameter in advance in correspondence with the vehicle status information, wherein the control section reads the setup value from the setup value storage in response to the vehicle status information to control the reproduction parameter based on the read setup value with respect to each of the tracks, wherein the setup value storage stores a setting representing variations of the reproduction parameter in connection with variations of the vehicle status information with respect to each of the phrases, and wherein the control section controls the reproduction parameter of each of the tracks based on the setting and the vehicle status information, so that music is reproduced while following any variation of the reproduction parameter of the phrase of each of the tracks based on the vehicle status information.

2. A music reproduction apparatus according to claim 1, further comprising:

a travel environment information input section for inputting travel environment information representing a travel environment of a vehicle;

a phrase storage for storing the plurality of phrases in advance in correspondence with the travel environment information; and an assignment section for selectively assigning the plurality of phrases, which are stored in the phrase storage in correspondence with the travel environment information, to the plurality of tracks to reproduce the phrases assigned to the tracks.

3. A music reproduction apparatus according to claim 1, further comprising:

a travel environment information input section for inputting travel environment information representing a travel environment of a vehicle;

a transmitter for transmitting the travel environment information to a server;

a receiver for receiving a music file, which is selected in the server in response to the travel environment information and which includes the reproduction parameters; and a vehicle status information detection section for detecting the vehicle status so as to output the vehicle status information, wherein the reproduction section reproduces a musical tune based on the music file that is controlled in response to the reproduction parameters, which are set in advance in correspondence with the vehicle status information.

4. A music reproduction apparatus according to claim 3, wherein the transmitter transmits a reproduction record of a musical tune, which is repeatedly reproduced by the reproduction section, to the server, in which the music file and the reproduction parameters stored in correspondence with the vehicle status information are updated based on the reproduction record.

5. A music reproduction apparatus according to claim 1, further comprising:

a travel environment information input section for inputting travel environment information representing a travel environment of a vehicle;

a transmitter for transmitting the travel status information and the travel environment information to a server; and a receiver for receiving a music file having a corrected parameter based on the vehicle status information and the travel environment information, which is selectively read out by the server, wherein the music reproduction section reproduces the received music file.

6. A music reproduction apparatus comprising:

a vehicle status information input section for inputting vehicle status information representing a vehicle status;

a travel environment information input section for inputting travel environment information representing a travel environment of a vehicle;

a music data storage for storing music data;

a setup value control section for determining a function regarding variations of a reproduction parameter responding to the vehicle status information on the basis of the travel environment information and for controlling a setup value of the reproduction parameter on the basis of the vehicle status information according to the determined function; and a music reproduction section for reproducing the music data using the setup value.

7. A music reproduction apparatus according to claim 6, further comprising a selection section for selecting at least one music data from the music data storage, which stores a plurality of music data, based on the travel environment information, so that the music reproduction section reproduces the music data selected by the selection section.

8. A music reproduction apparatus comprising:

a reproduction section for repeatedly reproducing a phrase composed of at least one music reproduction unit;

an external condition information input section for inputting external condition information representing an external condition; and a reproduction time length control section for controlling a reproduction time length of the music reproduction unit included in the phrase in response to the external condition information.

9. A music reproduction apparatus according to claim 8, wherein after completion of reproduction of the music reproduction unit included in the phrase with the reproduction time length suiting the external condition information, the reproduction time length control section temporarily stops the reproduction and then starts reproducing the music reproduction unit included in a next phrase.

10. A music reproduction apparatus comprising:

a reproduction section having a plurality of tracks, wherein a first track repeatedly reproduces a first phrase composed of one measure, and a second track repeatedly reproduces a second phrase composed of a plurality of measures;

an external condition information input section for inputting external condition information representing an external condition; and a reproduction time length control section for controlling a reproduction time length of the first phrase reproduced by the first track in response to the external condition information, wherein the reproduction time length control section controls the reproduction section to start reproducing the measures included in the second phrase reproduced by the second track at a reproduction end timing of the first phrase.

* * * * *